US010390593B2

(12) United States Patent
English et al.

(10) Patent No.: US 10,390,593 B2
(45) Date of Patent: Aug. 27, 2019

(54) CONTACT LENS BLISTER PACKAGES

(71) Applicant: COOPERVISION INTERNATIONAL HOLDING COMPANY, LP, St. Michael (BB)

(72) Inventors: Stephen English, Eastleigh (GB); Hayden Atkinson, Eastleigh (GB); Robert Davis, Eastleigh (GB); Kevin Aldridge, Hamble (GB)

(73) Assignee: CooperVision International Holding Company, LP, St. Michael (BB)

( * ) Notice: Subject to any disclaimer, the term of this patent is extended or adjusted under 35 U.S.C. 154(b) by 732 days.

(21) Appl. No.: 14/395,431

(22) PCT Filed: Apr. 23, 2013

(86) PCT No.: PCT/GB2013/051022

§ 371 (c)(1),
(2) Date: Oct. 17, 2014

(87) PCT Pub. No.: WO2013/160667

PCT Pub. Date: Oct. 31, 2013

(65) Prior Publication Data

US 2015/0114851 A1 Apr. 30, 2015

Related U.S. Application Data

(60) Provisional application No. 61/637,163, filed on Apr. 23, 2012.

(51) Int. Cl.
*A45C 11/04* (2006.01)
*B65D 75/32* (2006.01)
(Continued)

(52) U.S. Cl.
CPC ..... *A45C 11/046* (2013.01); *B65B 5/04* (2013.01); *B65B 55/22* (2013.01); *B65D 75/326* (2013.01); *B65D 2585/545* (2013.01)

(58) Field of Classification Search
CPC ..... B65D 1/30; B65D 1/34; B65D 75/32; B65D 75/36; B65D 75/366; B65D 75/42;
(Continued)

(56) References Cited

U.S. PATENT DOCUMENTS 3,442,378 A * 5/1969 Wolfe ..... 206/459.5
4,691,820 A * 9/1987 Martinez ..... 206/205
(Continued)

FOREIGN PATENT DOCUMENTS

CN 101237790 A 8/2008
CN 101252853 A 8/2008
(Continued)

OTHER PUBLICATIONS

International Search Report dated Sep. 2, 2013 from corresponding PCT Application No. PCT/GB2013/051022 (5 pages).
(Continued)

*Primary Examiner* — J. Gregory Pickett
*Assistant Examiner* — Brijesh V. Patel
(74) *Attorney, Agent, or Firm* — Klein, O'Neill & Singh, LLP

(57) ABSTRACT

Contact lens blister packages and related methods are described. The present devices include a thermoplastic base member with a grip portion, a distal end region, a first side region extending from the proximal end region to the distal end region, a second side region opposing the first side region, and a cavity configured to contain a packaging solution and a contact lens. The cavity comprises has a bottom wall with a bottom wall perimeter and a sidewall extending upwardly from the bottom wall perimeter to an upper cavity edge defining a cavity perimeter. A plane formed at the intersection of the bottom wall perimeter with the sidewall slopes away from the substantially linear portion of the cavity perimeter.

20 Claims, 5 Drawing Sheets

(51) Int. Cl.
*B65B 5/04* (2006.01)
*B65B 55/22* (2006.01)

(58) Field of Classification Search
CPC ..... B65D 75/527; B65D 75/585; B65D 77/2032; B65D 77/2024; B65D 2575/3227; B65D 2575/3245; B65D 2577/045; B65D 2585/545; A61F 2/1691; A61F 9/0061; A45C 11/005; A45C 11/046; A45C 2011/006; B65B 5/04; B65B 7/2878; B65B 25/008; B65B 55/22; G02B 1/043; Y10S 134/901; Y10S 206/82
USPC ..... 206/5.1, 205, 210, 438, 469, 471, 524.1, 206/525, 526, 820; 134/901; 53/428, 53/431
See application file for complete search history.

(56) References Cited

U.S. PATENT DOCUMENTS 5,467,868 A * 11/1995 Abrams et al. ..... 206/5.1
5,609,246 A * 3/1997 Borghorst et al. ..... 206/5.1
5,620,088 A * 4/1997 Martin et al. ..... 206/5.1
5,704,468 A * 1/1998 Lust et al. ..... 206/5.1
5,711,416 A * 1/1998 Bauman ..... A45C 11/005 206/210
5,722,536 A * 3/1998 Pierce et al. ..... 206/5.1
RE37,558 E * 2/2002 Abrams et al. ..... 206/5.1
6,398,018 B1 * 6/2002 Livesley et al. ..... 206/210
6,543,614 B2 * 4/2003 Nii ..... B65D 75/326 206/316.1
6,889,825 B2 * 5/2005 Ichikawa et al. ..... 206/5.1
D511,893 S * 11/2005 Chou ..... D3/263
D543,103 S * 5/2007 Roche et al. ..... D3/264
D556,602 S * 12/2007 Clements et al. ..... D9/732
D559,706 S * 1/2008 Clements et al. ..... D9/732
7,426,993 B2 * 9/2008 Coldrey et al. ..... 206/5.1
7,477,366 B2 * 1/2009 Clements et al. ..... 356/124
7,819,241 B2 * 10/2010 Post-Smith ..... A45C 11/005 206/5.1
2002/0046958 A1 * 4/2002 Lipscomb et al. ..... 206/5.1
2003/0029736 A1 * 2/2003 Phillips et al. ..... 206/5.1
2005/0218012 A1 * 10/2005 Tanaka et al. ..... 206/5.1
2006/0213784 A1 * 9/2006 Tokarski ..... B65D 81/22 206/5.1
2006/0249403 A1 * 11/2006 Newman ..... 206/5.1
2006/0260956 A1 * 11/2006 Stachowski ..... B65B 25/008 206/5.1
2011/0024310 A1 * 2/2011 O'Neill et al. ..... 206/205
2011/0062607 A1 * 3/2011 Clements ..... B29D 11/0023 264/2.6

FOREIGN PATENT DOCUMENTS

EP 1 752 058 A1 2/2007
EP 1 930 243 A2 6/2008
EP 2 295 229 A2 3/2011
EP 2840927 B1 11/2015
GB 2 418 418 A 3/2006
JP 62-122969 6/1987
JP 2006-16049 A 1/2006
JP 2007-44536 2/2007
JP 2008-513076 A 5/2008
JP 2008-174306 7/2008
JP 2009-544999 A 12/2009
TW 200840775 10/2008
TW I341279 5/2011
TW I362349 4/2012

OTHER PUBLICATIONS

Written Opinion dated Sep. 2, 2013 from corresponding PCT Application No. PCT/GB2013/051022 (5 pages).
Examiner's Report on corresponding foreign application (TW Application No. 102114437) from the Intellectual Property Office dated Jul. 31, 2015.
Examiner's Report on corresponding foreign application (JP Application No. 2015-507592) from the Japanese Patent Office dated Jan. 18, 2016.
Examiner's Report on corresponding foreign application (CN Application No. 201380021545.4) from the State Intellectual Property Office dated May 27, 2015.
Examiner's Report on corresponding foreign application (JP Application No. 2015-507592) from the Japanese Intellectual Property Office dated Jun. 29, 2015.
Modified Substantive Examination Report on corresponding foreign application (MY Application No. PI 2014703133) from the Malaysian Patent Office dated Feb. 28, 2018.

* cited by examiner

CONTACT LENS BLISTER PACKAGES

FIELD

The present disclosure is directed to contact lens blister packages and methods for making and using blister packages for producing packaged contact lenses.

BACKGROUND

During the manufacture of contact lenses, including conventional hydrogel contact lenses and silicone hydrogel contact lenses, a polymerizable lens-forming composition containing reactive ingredients is polymerized to form polymerized lenses, for example, using a cast molding process. The polymerized lenses can subsequently be inspected for defects, packaged in a packaging fluid, sealed with sealing elements and sterilized for distribution.

Typically, each contact lens is packaged in a plastic contact lens blister package, which includes a relatively rigid plastic base member having a cavity configured to contain a contact lens and a packaging solution, and a relatively more flexible sealing material such as foil attached to the plastic base member. Multiple contact lens blister packages can be provided in a box or a carton, which are subsequently shipped to distributors, medical practitioners or consumers. A contact lens will remain in its blister package for a significant amount of time before it is used by the consumer, sometimes up to 7 years. Thus, there is a need for blister packages which are both functional and attractive from the consumer's standpoint, and which are also capable of adequately protecting the lens during its shelf life while minimizing manufacturing, storage and shipping costs.

SUMMARY

New contact lens packages and methods for producing packaged contact lenses using these contact lens packages are described. The contact lens blister package described herein comprises a thermoplastic base member comprising a proximal end region 34 having a grip portion 62, and a distal end region 36. The base member 22 also comprises a first side region 38 extending from the proximal end region 34 to the distal end region 36, and a second side region 40 opposing the first side region 38. The base member 22 also comprises a cavity 26 configured to contain a packaging solution and a contact lens. The cavity 26 of the base member 22 is located between the proximal end region 34 of the base member 22 and the distal end region 36 of the base member 22, and between the first side region 38 of the base member 22 and the second side region 40 of the base member 22. The cavity 26 of the base member 22 also comprises a bottom wall 48 having a bottom wall perimeter 54, and a sidewall 50 extending upwardly from the bottom wall perimeter 54 to an upper cavity edge defining a cavity perimeter 28. The cavity perimeter 28 of the cavity 26 of the base member 22 comprises a substantially linear portion and a non-linear portion opposing the substantially linear portion. Additionally, in the base member 22, a plane 59 formed at the intersection of the bottom wall perimeter 54 with the sidewall 50 slopes away from the substantially linear portion of the cavity perimeter 28. With the devices and methods described herein, it is possible to contain a contact lens in a cavity 26 having a cavity perimeter 28 which includes a linear portion (i.e., a cavity having a perimeter which is not entirely curved) while reducing the potential for a contact lens stored in the cavity to deform due to the lens resting against the linear portion of the sidewall 50 for extended periods of time. In blister packages having cavities including linear sidewall portions (i.e., blister packages having cavities with perimeters and sidewalls which are not entirely curved into each other, and having a cavity perimeter with a linear portion), it has been found that, by making the plane 59 formed at the intersection of the bottom wall 48 and the sidewall 50 slope away from the linear portion of the cavity perimeter 28, the tendency for the lens to rest in contact with the linear portion of the cavity sidewall 50 during storage can be reduced, which in turn prevents or reduces deformation of the lens caused by the lens resting in contact with the linear portion of the cavity perimeter during storage. For example, the plane 59 can slope away from the linear portion of the cavity perimeter 28 at an angle of at least 5°, or at least 10°, or at least 15°. Due to the slope, the depth of the cavity along the substantially linear portion of the cavity perimeter 28 can be less than the depth of the cavity at a location along the non-linear portion of the cavity perimeter opposing the substantially linear portion. For example, the depth of the cavity along the linear portion can be at least 5% less, or at least 10% less, or at least 15% less than the depth of the cavity along the non-linear portion of the cavity perimeter 28.

Blister package base members with cavities having linear perimeter portions which can contact a linear perimeter portion of another blister package base member when stacked in an inverted reverse arrangement can form more stable stacks and arrays as compared to blister package base members having cavities which are entirely curved or having linear perimeter portions which cannot contact a linear perimeter portion of another blister package base member when stacked in an inverted reverse arrangement. With the present devices and methods it can also be possible to improve the packaging efficiency of a box or carton of contact lens packages. The present devices and methods can be useful in producing contact lens package arrays or assemblies wherein individual blister packages are configured to be compactly and securely stacked with adjacent blister packages to enable packaging relatively large quantities of blister packages in relatively small shipping cartons or boxes. For example, the present blister packages can be configured such that a first blister package is compactly and securely stacked against a second blister package, which is substantially identical to the first blister package in an inverted reverse stacking arrangement. As the blister packages are more efficiently stacked, more blister packages may be packaged in a given box. In addition, the contemplated box for containing the present blister packages can be more compact in width or height or both width and height to enable fitting into a regular mail box or a mail slot located on a door. This can reduce shipping costs while also reducing the risk of the box containing the packages getting lost when not properly delivered, such as when left outside the door or mail box.

In one example, the present devices and methods can also be useful in producing contact lens blister packages useful for automated lens inspection. In one example, when the cavity of the blister package base member comprises a light collimation cavity, the contact lens disposed in a liquid medium contained therein can be inspected by either manual or automatic inspection procedures. With this example of the present devices and methods, it can be possible to improve manufacturing yield and efficiency, as a contact lens can be inspected directly in the blister package, therefore obviating the need for transfer to a separate inspection receptacle. By minimizing the number of transfers from one receptacle to another, potential damage to the lens from physical handling of the lens is reduced, along with the risk of losing lenses during transfers, both of which can improve yield. In addition, in one example of the present blister package wherein when the blister package base member is positioned on a horizontal surface with the cavity opening facing up and with both the proximal end of the package and the bottom surface of the cavity contacting the horizontal surface, the plane formed at the intersection of the bottom surface and the sidewall surface is parallel to the horizontal surface, the packaged contact lens remains centered in the cavity when the package is placed on a horizontal surface, thus facilitating the inspection procedure. Use of the blister package of this example can improve the yield of contact lens manufactured by reducing damage which may result from moving the lens to another receptacle, and also eliminates the need for a separate carrier to hold the blister package in a position such that the lens can be centered in the blister package during inspection.

In one example, a contact lens blister package is provided having a relatively small profile for high density packing into a package carton. One example of such a contact lens blister package comprises a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the cavity 26 has a volume of from 1.7 milliliters ("mm") to 2.5 milliliters; the cavity 26 has a maximum length of 18.9 mm, a maximum width of 22.5 mm, and a maximum depth of 8.7 mm; the base member 22 has a maximum length of 47.8 mm, a maximum width of 30.5 mm, and a maximum depth of 9.5 mm, and a maximum wall thickness of 1.00 mm; and dimensions of the package are substantially the same following autoclaving as before autoclaving.

In another example, a contact lens package assembly is provided. A contact lens package assembly in accordance with the present example can comprise: a first blister package 20*a* and a second blister package 20*b*, wherein the second blister package 20*b* is substantially identical to the first blister package 20*a*; the first blister package 20*a* and the second blister package 20*b* each comprises a thermoplastic base member 22*a*, 22*b* comprising a proximal end region 34*a*, 34*b* having a grip portion 62*a*, 62*b*; a distal end region 36*a*, 36*b*; a first side region 38*a*, 38*b* extending from the proximal end region 34*a*, 34*b* to the distal end region 36*a*, 36*b*; a second side region 40*a*, 40*b* opposing the first side region 38*a*, 38*b*; and a cavity 26*a*, 26*b* configured to contain a packaging solution and a contact lens, the cavity 26*a*, 26*b* being located between the proximal end region 34*a*, 34*b* and the distal end region 36*a*, 36*b* and between the first side region 38*a*, 38*b* and the second side region 40*a*, 40*b*; the cavity 26*a*, 26*b* comprises a bottom wall 48*a*, 48*b* having a bottom wall perimeter 54*a*, 54*b* and a sidewall 50*a*, 50*b* extending upwardly from the bottom wall perimeter 54*a*, 54*b* to an upper cavity edge defining a cavity perimeter 28*a*, 28*b*; the cavity perimeter 28*a*, 28*b* comprises a substantially linear portion and a non-linear portion opposing the substantially linear portion; and a plane 59*a*, 59*b* formed at the intersection of the bottom wall perimeter 54*a*, 54*b* and the sidewall 50*a*, 50*b* slopes away from the substantially linear portion of the cavity perimeter 28*a*, 28*b*; and the base member 22*a* of the first blister package 20*a* and the base member 22*b* of the second blister package 20*b* are configured such that the second base member 22*b* is stackable against the first base member 22*a* in an inverted reverse arrangement. In one example, the linear sidewall portion of the first base member 22*a* forms a line contact 72 with the linear sidewall portion of the stacked second base member 22*b*. In another example, the first base member 22*a* and the second base member 22*b* each further comprises a support rib 32*a*, 32*b* extending from a distal most end 37*a*, 37*b* of the base member 22*a*, 22*b*, and wherein the proximal edge 35*a* of the first base member 22*a* abuts the support rib 32*b* of the stacked second base member 22*b* when the first base member 22*a* and the second base member 22*b* are stacked in an inverted reverse arrangement. In yet another example, the base member 22*a* of the first contact lens blister package 20*a* is configured to enable stacking against the second contact lens blister package 20*b* in an inverted reverse arrangement to form a stack of two substantially identical contact lens blister packages having a height of from 1.0 to 1.25 times a height H of the first blister package 20*a*, a length of from 1.0 to 1.25 times a length L of the first blister package 20*a*, and a width of from 1.0 to 1.25 times a width W of the first blister package 20*a*.

Methods of manufacturing packaged contact lenses, including conventional hydrogel and silicone hydrogel contact lenses, are also described herein. A method of manufacturing a packaged contact lens in accordance with the present disclosure comprises: providing a demolded and delensed polymeric contact lens body; placing the contact lens body in a thermoplastic base member 22 of a contact lens blister package 20 with a packaging solution; and sealing the contact lens blister package with a sealing member 24; wherein the base member 22 comprises a proximal end region 34 having a grip portion 62, a distal end region 36, a first side region 38 extending from the proximal end region 34 to the distal end region 36, a second side region opposing the first side region 38, and a cavity 26 configured to contain a packaging solution and a contact lens, the cavity 26 being located between the proximal end region 34 and the distal end region 36 and between the first side region 38 and the second side region 40; the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28.

Additional examples and details of the present devices and methods are also described in the following detailed description, drawings, and appended claims.

Various examples of the present devices and methods are described in detail in the detailed description and claims below. Any feature or combination of features described herein are included within the scope of the present disclosure and in combination whether expressly described provided that the features included in any such combination are not mutually inconsistent as will be apparent from the context of the described features and knowledge of one of ordinary skill in the art. In addition, any feature or combination of features may be specifically excluded from any example of the present invention.

DETAILED DESCRIPTION

Figure 1:
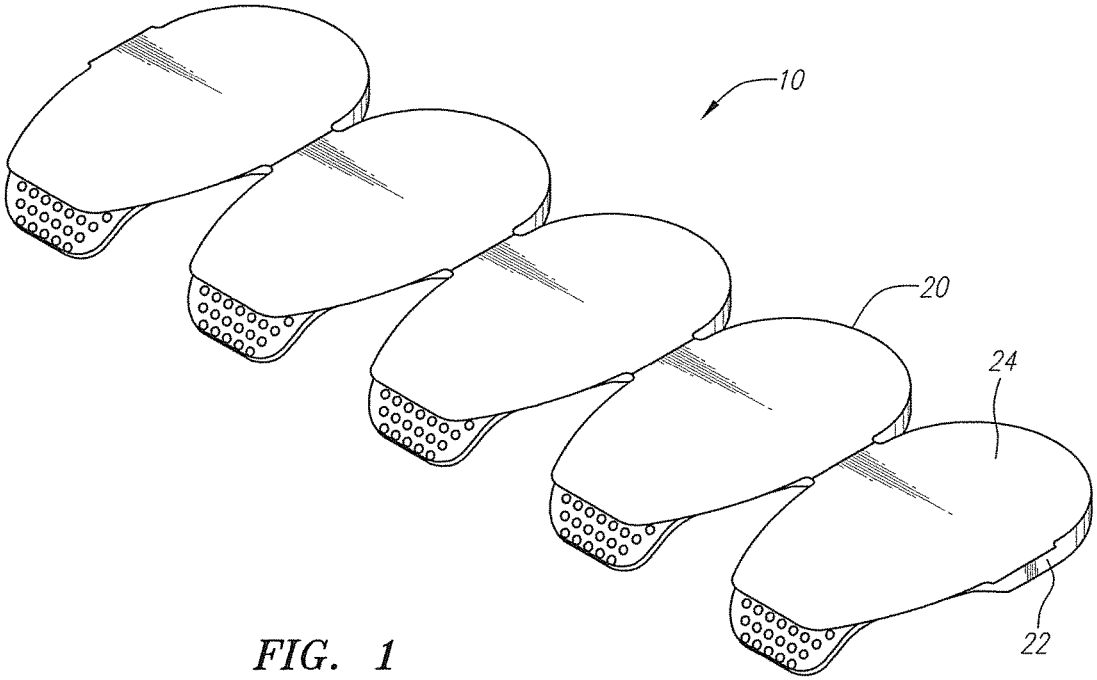
FIG. 1 is a perspective view of an array of sealed contact lens blister packages.

The following disclosure is directed to devices and methods for packaging contact lenses. More particularly, the present devices and methods are directed to blister packages which can be used to hold contact lenses during shipping and storage. In one example, the blister packages can also be used to hold contact lenses during their manufacturing process, including during washing, inspecting, packaging or any combination thereof. Devices and methods of the present disclosure can be used with hydrogel contact lenses, including conventional hydrogel and silicone hydrogel contact lenses. The present devices and methods can be used with contact lenses formed using various methods known in the art, including cast molding, lathing, spin casting, etc.

In a typical cast molded contact lens manufacturing procedure, a polymerizable lens precursor composition, is placed in a lens-shaped cavity of a contact lens mold assembly formed of a first mold member and a second mold member. The contact lens mold assembly containing the polymerizable lens precursor composition is then exposed to conditions effective to polymerize (i.e., cure) the polymerizable lens precursor composition, such as exposure to heat, or UV light, or both. After the polymerization step, a polymeric contact lens body is present in the contact lens shaped cavity of the mold assembly. The contact lens mold assembly is then demolded to separate the first and second mold members from one another, leaving the polymeric lens body remaining in contact with one of the mold members. After demolding the contact lens mold assembly, the polymeric lens body is delensed or deblocked from the one remaining mold member to which it remained attached following the demolding step. Delensing can be performed using a dry delensing step not involving contacting the mold member and lens body with a liquid, or using a wet delensing step which involves contacting the lens body and the mold member with a liquid that assists in separating the lens body from the mold member to which it was attached or in contact at the start of the delensing step.

After delensing the polymerized contact lens product, the product can optionally undergo one or more processing steps that include washing, such as cleaning, extracting, and hydrating processes or combinations thereof, to produce a contact lens that is ready to be inspected or ready to be packaged. While it is not necessary to extract or hydrate all types of contact lenses prior to inspecting or packaging, conventionally most hydrogel lenses undergo a hydration step, and most silicone hydrogel lenses undergo extraction and hydration steps, prior to being sealed in contact lens packages. The hydrated contact lenses can then be placed in a base member of a blister package with a packaging solution, sealed in the blister package, and the blister package can then be sterilized, as understood by persons of ordinary skill in the art.

Optionally, the contact lenses can be inspected before or after being placed in a base member of a blister package. In some processes, each contact lens is transferred to an inspection tray prior to being inspected. A typical inspection tray comprises one or more cavities having a cavity bottom suitable for inspection, i.e., a cavity bottom which is sufficiently clean and clear to allow detection of defects of a lens present in the cavity. For example, the cavity can be capable of collimating light, i.e., the cavity can be a light collimation cavity. A preferred method is to place the contact lens body directly into a contact lens blister package which is configured to allow inspection of the lens within the package before or after sealing. An example of such a blister package is described in U.S. Pat. No. 7,477,366, the contents of which are expressly incorporated herein by reference. Alternatively or in addition thereto, the lenses can be inspected in a dry state before being exposed to a liquid in a washing step or a hydrating step. Inspecting the lenses in a dry state is often referred to as dry inspection of the lenses. Although these steps can be performed manually, in a commercial manufacturing process, typically many steps are automated.

As used herein, a soft contact lens is a contact lens that can conform to the shape of the cornea of an eye of a lens wearer or can otherwise be folded upon itself without breaking. A hard contact lens is a contact lens that cannot be folded upon itself without breaking. A soft contact lens can be a hydrogel contact lens, that is, a contact lens that is capable of retaining water in an equilibrium state. The hydrogel contact lens can be a silicone-free hydrogel contact lens or a silicone hydrogel contact lens. Contact lenses usable with the devices and methods disclosed herein include hydrogel contact lenses. A silicone hydrogel contact lens is a hydrogel contact lens that comprises a silicone component. Examples of silicone hydrogel contact lenses that can be used with the present devices and methods include, but are not limited to, silicone hydrogel contact lenses having the following U.S. Adopted Names (USANs): lotrafilcon A, lotrafilcon B, balafilcon A, galyfilcon A, senofilcon A, comfilcon A, enfilcon A, and stenfilcon A. A non-silicone hydrogel contact lens is a hydrogel contact lens that is free of a silicone component. Examples of non-silicone hydrogel contact lenses that can be used with the present devices and methods include hydrogel contact lenses having the following USANs: omafilcon A, ocufilcon A, ocufilcon B, ocufilcon C, ocufilcon D, ocufilcon E, etafilcon A, methafilcon A, and methafilcon B, among others.

In one example, the contact lenses, or the packaging solutions, or both the contact lenses and the packaging solutions usable with the present devices and methods can include one or more comfort agents. Examples of comfort agents include wettability enhancing agents that enhance the wettability of contact lenses so that the contact lenses remain comfortable to a lens wearer, even at the end of the day or after prolonged continuous wear of the contact lenses, as described in U.S. Pat. No. 7,477,366, the contents of which are expressly incorporated herein by reference. In one example, the comfort agent can comprise a surfactant. Examples of surfactants include but are not limited to tweens, or poloxamers, or poloxamines, or any combination thereof. In another example, the comfort agent can include phosphoryl choline (PC) derivatives, such as a water-soluble polymer of PC, for example, a water-soluble polymer of methacrylate phosphoryl choline (MPC), or of 2-methacryloyloxyethyl phosphoryl choline (HEMA-PC), and the like, or any combination thereof.

The present disclosure is directed to a contact lens blister package comprising a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28. The present disclosure is also directed to a contact lens blister package assembly comprising: a first blister package 20*a* (FIG. 11) and a second blister package 20*b*, wherein the second blister package 20*b* is substantially identical to the first blister package 20*a*; the first blister package 20*a* and the second blister package 20*b* each comprises blister package in accordance with the present disclosure, and the base member 22*a* of the first blister package 20*a* and the base member 22*b* of the second blister package 20*b* are configured such that the second base member 22*b* is stackable against the first base member 22*a* in an inverted reverse arrangement. The present disclosure is also directed to a method of manufacturing a packaged contact lens comprising: providing a demolded and delensed polymeric contact lens body; placing the contact lens body in a thermoplastic base member 22 of a contact lens blister package 20 with a packaging solution; and sealing the contact lens blister package with a sealing member 24; wherein the base member of the contact lens blister package is a base member of a contact lens blister package in accordance with the present disclosure.

Referring now to FIG. 1, a perspective view of an array 10 of contact lens blister packages 20 is shown. In the illustrated example, the array 10 comprises five blister packages. In an alternative example, the array 10 can comprise less than five blister packages, such as two blister packages. In yet another example, the array 10 can comprise more than five blister packages, for example seven or ten or more blister packages.

Figure 2:
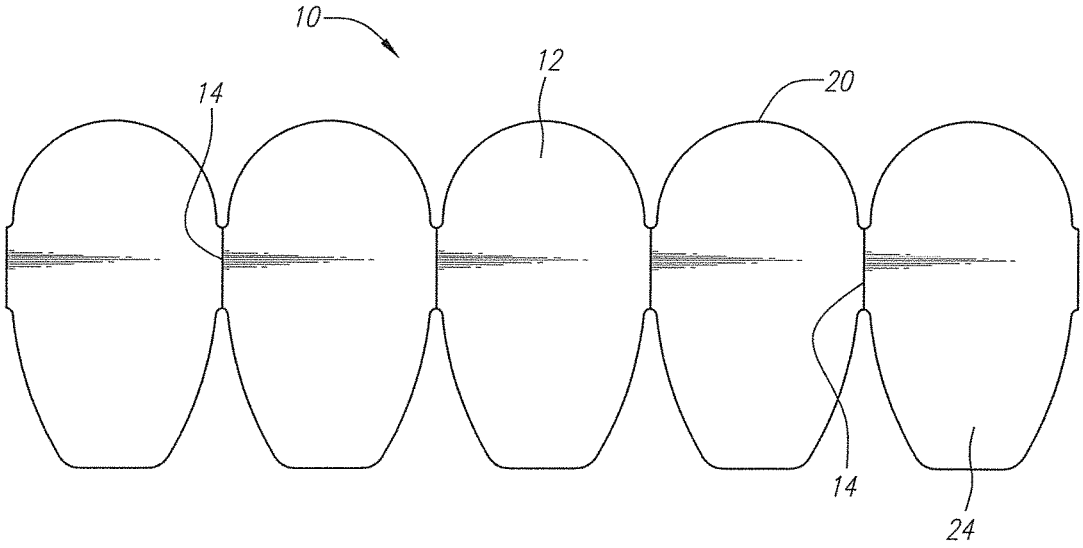
FIG. 2 is a top plan view of the array of FIG. 1.

Each of the blister packages 20 of the array 10 is dimensioned to accommodate a single contact lens (not shown). In one example, in addition to a contact lens, the blister package 20 further comprises a liquid medium, for example, a packaging solution. Each blister package 20 comprises a base member 22 having a cavity 26 (FIG. 3) and a cover or sealing member 24. The sealing member 24 provides a fluid impervious seal along the perimeter of the package cavity 26 to prevent spilling and contamination of a sterilized contact lens disposed in the liquid medium contained in a sealed base member 22. In one example, the sealing member 24 can be effective to retain the contact lens and packaging solution in the cavity of the blister package in a sterile condition for the shelf life of the product. FIG. 2 illustrates a top plan view of the array of FIG. 1, which shows the base members 22 being covered by a sealing layer 12. In one example, the sealing layer 12 comprises a plurality of sealing members or covers 24 corresponding to the number of base members 22.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; a contact lens and a packaging solution present in the cavity 26, and a removable sealing member 24 sealing the cavity 26 of the base member 22.

Figure 3:
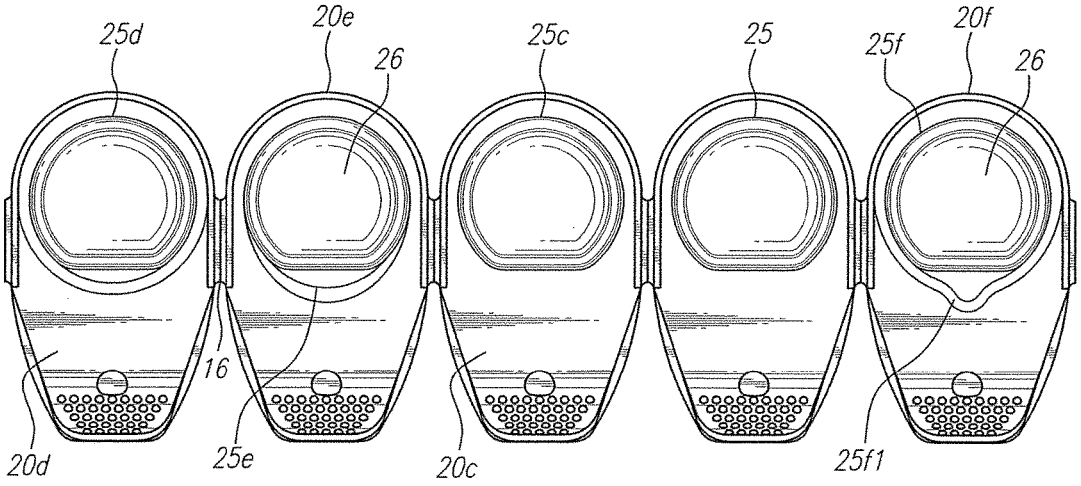
FIG. 3 is a top plan view of the array of contact lens blister packages of FIG. 1 with the sealing layers removed to reveal the cavities of the blister packages.

With reference also to FIG. 3, in one example, the sealing member 24 can be heat sealed to a sealing area 25 of the base member 22. The sealing area 25 is understood to be an area on the base member 22 that surrounds the cavity 26. In an example, the sealing area 25 comprises a band 25*c* with a pre-determined uniform width that extends generally around the perimeter of the cavity 26 and has the general shape or configuration of the perimeter, as illustrated on blister package 20*c*. In another example, the sealing area 25 has a different shape or configuration than the shape of the cavity perimeter. For example, the sealing area 25 can have a shape of a circular ring 25*d*, as illustrated on blister package 20*d*. In another example, the sealing area is an oval shaped ring 25*e*, as shown on blister package 20*e*. In yet another example, the sealing area is a substantially circular ring shape 25*f* having a proximal extension 25*f*1 as shown on blister package 20*f*. Although the blister packages 20*c*, 20*d*, 20*e*, and 20*f* with different sealing configurations are shown in the illustrated example in the same array 10, in other examples, the blister packages of the same array 10 can have the same sealing configuration 25. In another example, the sealing area 25 can have other suitable configurations, such as a combination of the sealing areas shown, for effectively heat sealing the sealing member 24 to the base member 22.

The different sealing configurations provide different sealing options for generating more or less adhesion between the sealing member 24 and the base member 22 to increase or decrease the force needed to separate the two components by peeling the sealing member 24. The width or band of the sealing area 25 can have a constant or variable thickness. The sealing member 24 may be attached to the base member 22 using a heat die with a suitable shape for forming the desired sealing configuration. In another example, adhesive or other suitable attachment means for attaching the sealing member 24 to the base member 22 may be used instead of a heat die. The sealing member 24 is preferably not attached to the base member 22 beyond or outside the sealing area 25 to permit separation between the two. The sealing member 24 can be grasped at a non-attached area, such as the portion of the sealing member 24 above the gripping portion 62 of the base member (FIG. 4), and removed from the base member 22.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the base member 22 comprises a sealing area 25 having a different configuration than the cavity perimeter 28.

The sealing layer 12 can be formed from a variety of materials. In one example, the sealing layer 12 can be made of a multi-layer film comprising a foil material and a meltable thermoplastic layer. In another example, the sealing layer 12 can be made from other materials suitable for packaging a contact lens and a packaging solution. Materials suitable for a sealing layer should be able to remain attached to the base member to maintain a contact lens contained therein in a sterile condition until removed by a user. For example, the sealing member material should be able to withstand rigorous sterilizing conditions, including but not limited to autoclaving, gamma radiation, ultraviolet radiation, and the like without compromising the properties of the sealing member. The sealing member material should also be able to withstand shipping and storage conditions for the shelf life of the product, which can be up to 7 years. The sealing layer 12 may also include indicia, such as letters, numbers, bar code, graphics, or combinations thereof. Exemplary thermoplastic materials include a polypropylene-polyethylene copolymer film layer and/or a styrene ethylene-butylene styrene thermoplastic elastomer film layer.

In one example, the sealing layer 12 comprises a plurality of weakened portions 14 provided between adjacent sealing members 24. In one example, the weakened portions 14 comprise perforated portions or perforations to facilitate tearing or separation of the individual blister packages. In another example, the weakened portions 14 may be formed without perforations but with indentations, undercuts or sections with reduced thickness to provide a weakened section for tearing. In another example, the base member 22 can be connected to at least one adjacent base member by a connecting element 16. The connecting element 16 may embody frangible elements or tear tabs that connect one base member to an adjacent base member. In one example, the connecting element 16 can be integrally formed to two adjacent base members 22, such as during injection molding or during thermoforming. In another example, the connecting element 16 can comprise external securing members configured to attach two adjacent base members together. In one example, the blister packages 20 of the array 10 can be held together by the connecting elements 16 located between two adjacent base members and by the sealing layer 12, more specifically by the weakened portions 14 located between adjacent sealing members 24. In another example, the blister packages 20 can be connected together only by the connecting elements 16 located between the base members 22 and not by the weakened portions 14 of the sealing layer 12. In yet another example, the blister packages 20 can be connected together solely by weakened portions 14 of the sealing layer 12.

Figure 4:
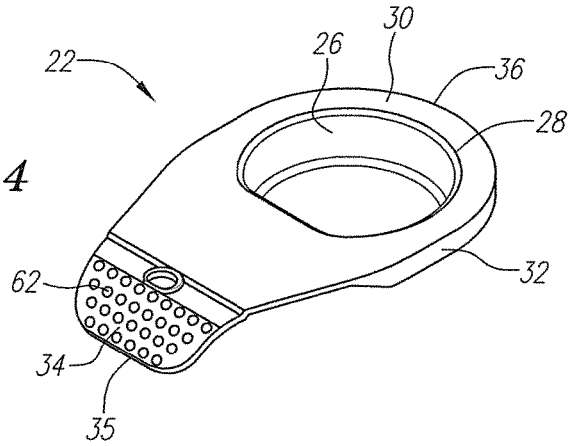
FIG. 4 is a perspective view of a single unsealed contact lens blister package.
Figure 5:
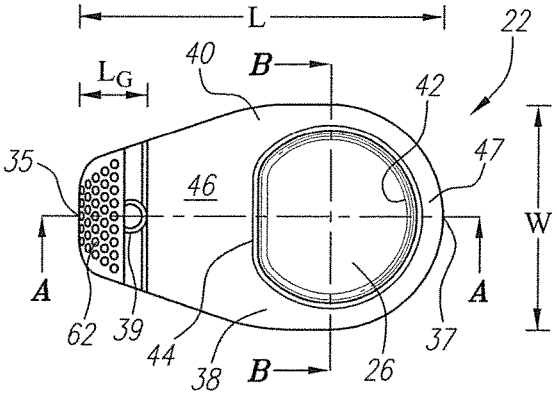
FIG. 5 is a top plan view of the contact lens package of FIG. 4.

FIGS. 4 and 5 illustrate perspective and top plan views, respectively, of a single base member 22. As shown, the cavity 26 of the base member 22 comprises a cavity perimeter 28. The cavity 26 is dimensioned, such as sized and shaped, to accommodate a hydrated contact lens in a liquid medium. The base member 22 further comprises a flange 30 surrounding the cavity perimeter 28 and extending outwardly therefrom. Optionally, the flange 30 can be strengthened by incorporating a support rib 32 extending downwardly from an outer edge of the flange 30. The support rib 32 can form a channel or race 33 with the bottom wall surface 50 of the cavity (FIG. 8).

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the base member 22 further comprises a flange 30 extending outwardly from the cavity 26, and the flange 30 comprises a sealing area 25.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the base member 22 further comprises a flange 30 extending outwardly from the cavity 26, a support rib 32 extending from a distal most end of the flange 30, and the flange 30 includes a sealing area 25. The blister package of this example can optionally further comprise a contact lens and a packaging solution in the cavity 26, and can further comprise a removable sealing member 24 attached to the sealing area 25, the sealing member 24 being effective to seal the cavity portion of the base member and to maintain the contents of the cavity in a sterile condition for up to 7 years.

Figure 6:
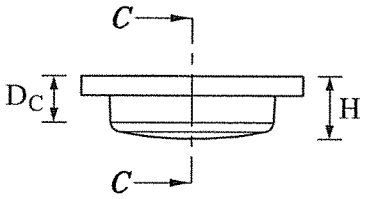
FIG. 6 is a back elevation view of the package of FIG. 5.
Figure 7:
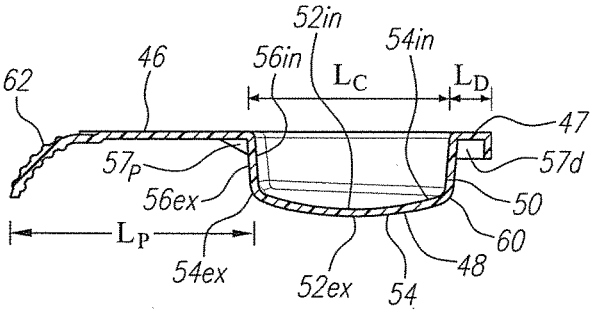
FIG. 7 is a sectional side view of the contact lens package of FIG. 5 taken along line A-A.
Figure 8:
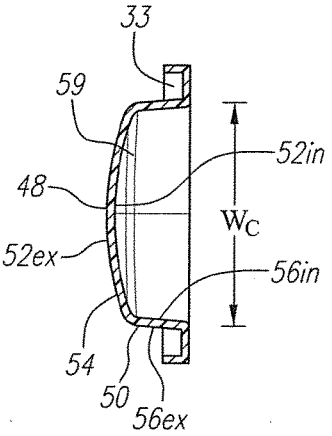
FIG. 8 is a sectional view of the contact lens package of FIG. 5 taken along line B-B.

As shown in FIGS. 6, 7 and 8, the illustrated base member has sidewalls 50 which slope in from the top of the flange 30 toward the bottom wall 48 of the cavity 26. For example, all or portions of the cavity sidewall 50 can extend from the planar flange region toward a central region of the cavity 26 at an angle of from 80 degrees to less than 90 degrees. In another example, all or portions of the cavity sidewall 50 can be vertical, i.e., can extend from the planar flange region toward a central region of the cavity 26 at an angle of about 90 degrees. In yet another example, all or portions of the cavity sidewall 50 can slope out away from a central region of the cavity 26, for example, at an angle of 5 degrees or more.

The base member 22 of the contact lens blister package of the present disclosure may be made from a variety of materials. In certain examples, including in the illustrated example, the base member 22 can be formed from a thermoplastic material and by any conventional technique, for example, by injection molding or thermoforming. Thus, the base member 22 as disclosed herein can comprise, consist essentially of, or consist entirely of, a thermoplastic material. Similarly, the present base member 22 can comprise, consist essentially of, or consist entirely of an injection molded base member 22. In one example, the base member 22 is made of a polyolefin resin material, such as polypropylene. However, other thermoplastic materials such as polycarbonate and polyethylene may be used.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the base member 22 consists essentially of polypropylene.

In one example, the base member 22 can be made from a thermoplastic material capable of transmitting light so that an image of a contact lens in a liquid medium located in the cavity 26 can be obtained for inspection, as shown and described in the '366 patent, previously incorporated herein by reference. In one example, the cavity 26 can be understood to be a light collimation cavity and can cooperate with a liquid medium (e.g., a packaging solution or an inspection liquid) and the contact lens located therein to collimate partially collimated light to provide a uniform bright field image of the contact lens during an inspection procedure. In other words, the combination of the cavity bottom wall 48 (FIG. 7), the contact lens present in the cavity 26, and the liquid medium present in the cavity 26 can cooperate to fully collimate light as the light is directed through the cavity 26. In one example, the collimated light can be directed to a camera used to inspect the contact lens. Thus, contact lens blister package can be a contact lens blister package comprising a thermoplastic base member 22 comprising a light collimation cavity 26, the light collimation cavity 26 dimensioned to accommodate a contact lens in a liquid medium present in the cavity 26 and configured to collimate partially collimated light to provide an image of the contact lens during an inspection procedure.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the cavity 26 comprises a light collimation cavity. In a specific example of the blister package having a light collimation cavity, the light collimation cavity can comprise a sealing area 25 with a configuration that is similar to a cavity perimeter 28 configuration of the cavity 26. In another example, the sealing area 25 can have a different configuration than the cavity perimeter 28 configuration of the cavity 26. For example, the sealing area 25 can have a round configuration or an oval configuration as shown on the blister package 20*b* or 20*c* in FIG. 3, while the cavity perimeter 28 configuration can be round with a truncated section, as shown in FIG. 5. In another example, the sealing area 25 can be round with an elongated proximally extending section 25*d*1, such as that shown on the blister package 20*d* in FIG. 3.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the cavity 26 comprises a light collimation cavity, and the base member 22 comprises a sealing area 25 having a different configuration than the cavity perimeter 28.

In another specific example of the blister package having a light collimation cavity, the light collimation cavity can comprise indicia formed in the bottom wall 48 of the cavity for assisting in determining the position of the base member 22 during an inspection process. For example, the indicia can comprise bumps or lines or both. The indicia can be configured to be visible to an automated inspection system. The indicia can be present on the exterior surface of the bottom wall 48 of the cavity.

Referring again to FIGS. 4 and 5, the base member 22 comprises a proximal end region 34 terminating in a proximal edge 35, a distal end region 36 having a distal most end 37, a first lateral side region 38 and an opposing second lateral side region 40. The proximal end region 34 defines a gripping portion 62 for manipulating the blister package, as further discussed below in connection with FIGS. 9 and 10. In one example, such as in the illustrated example, the proximal end region 34 may comprise a gate recess 39, which can optionally be located elsewhere on the base member 22.

The base member 22 can be characterized by a length L measured along a lengthwise central axis A-A, which extends from the proximal edge 35 to the distal most end 37, and a width W measured along a widthwise axis B-B, which is orthogonal to the axis A-A. The widthwise axis B-B extends from the first lateral side 38 to the opposing second lateral side 40 (FIG. 5). In one example, the length L of the base member 22 can range from about 40 mm to about 60 mm. In another example, the base member 22 can have a maximum length of 47.8 mm, or of 47.3 mm, or of 46.5 mm. In yet another example, the length L of the base member 22 can be about 46 mm, or about 46.3 mm. In one example, the width W of the base member 22 can range from about 20 mm to about 40 mm. In another example, the base member 22 can have a maximum width of 30.5 mm, or of 30.0 mm, or of 29.5 mm, or of 29.2 mm. In yet another example, the width W of the base member 22 is about 29 mm.

FIG. 6 shows a back elevation view of the base member 22. As illustrated in FIG. 6, the base member comprises a height H measured along a vertical axis C-C from the top of the sealing member 24 to the bottom surface of the cavity 52. In one example, the height H of the base member can range from about 7.5 mm to about 10 mm. In another example, the base member can have a maximum height H of 9.5 mm, or of 9.0 mm, or of 8.5 mm, or of 8.2 mm. In yet another example, the maximum height H can be about 8 mm.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the base member 22 has a maximum length L of 47.8 mm, a maximum width W of 30.5 mm, and a maximum height H of 9.5 mm.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the base member 22 has a length L of about 47 mm, a width W of about 29 mm, and a height H of about 8 mm.

With further reference to FIGS. 7 and 8, the cavity 26 can be characterized by a longest length $L_C$ and a widest width $W_C$. The length $L_C$ can be measured along the same perspective as the length L of the base member. In the example of a base member 22 illustrated in the figures, the length $L_C$ extends from the substantially linear proximal portion 44 of the cavity perimeter 28 to a distal most point of the perimeter 28. Said differently, the axis defining the length L of the base member and the axis defining the length $L_C$ of the cavity are co-axial. The length of the cavity or of the base member that extend along the axis A-A may be referred to as the central length of the cavity or of the base member. As shown, in the illustrated example of a base member 22, the distal most point of the cavity is located on the opposing substantially circular distal portion 42 along the lengthwise axis A-A. The width $W_C$ can be measured along the same perspective as the width W of the base member, along axis B-B. This width of the cavity or of the base member that extend along the axis B-B may be referred to as the central width of the cavity or of the base member. In other examples, the longest length may not align with the central length and the longest width may not align with the central width. With reference to FIG. 6, the cavity 26 can be characterized by a cavity depth $D_C$ as measured vertically from the top of the cavity perimeter 28 to the lowest point in the cavity. The cavity depth can also be measured along an interior surface of a cavity sidewall. As illustrated in FIG. 7, the cavity depth can be a cavity depth $D_{CL}$ measured along an interior surface of the substantially linear portion of the cavity perimeter, or the cavity depth can be a cavity depth $D_{CN}$ measured along an interior surface of the non-linear portion of the cavity perimeter opposing the substantially linear portion of the cavity perimeter.

The cavity 26 of the base member 22 can have a cavity length $L_C$ ranging from 16 mm to 20 mm. The cavity 26 of the base member 22 can have a maximum cavity length $L_C$ of 18.9 mm, or 18.4 mm, or 17.9 mm, or 17.6 mm. The cavity length $L_C$ can be about 17 mm, or about 17.4 mm. The cavity 26 of the base member 22 can have a cavity width $W_C$ ranging from 20 mm to 23 mm. The cavity 26 of the base member 22 can have a maximum cavity width $W_C$ of 22.5 mm, or 22.0 mm, or 21.5 mm, or 21.2 mm. The cavity width $W_C$ of the base member 22 can be about 21 mm. The cavity 26 of the base member 22 can have a cavity depth $D_C$ ranging from 6.5 mm to 9.0 mm. The cavity 26 of the base member 22 can have a maximum cavity depth $D_C$ of 8.7 mm, or 8.2 mm, or 7.7 mm, or 7.4 mm. The cavity depth $D_C$ of the base member 22 can be about 7 mm, or about 7.2 mm.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the base member 22 further comprises a flange 30 extending outwardly from the cavity 26, a support rib 32 extending from a distal most end of the flange 30, the flange 30 includes a sealing area 25, and the cavity width $W_C$ is greater than or equal to the cavity length $L_C$.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the cavity 26 of the base member 22 has a maximum cavity length $L_C$ of 18.9 mm, a maximum cavity width $W_C$ of 22.5 mm, and a maximum cavity depth $D_C$ of 8.7 mm.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the cavity 26 of the base member 22 has a cavity length $L_C$ of about 17.4 mm, a cavity width We of about 21.0 mm, and a cavity depth $D_C$ of about 7.2 mm.

The various elements of the base member 22 of the present contact lens blister packages can have a wall thickness defined as the distance between a first surface of the wall and a second surface of the wall. For example, the bottom wall 48 can have a bottom wall thickness defined as the distance between the exterior bottom wall surface $\mathbf{52}_{ex}$ and the interior bottom wall surface $\mathbf{52}_{in}$ of the cavity. The sidewall 50 of the cavity can have a sidewall thickness defined as the distance between the inner sidewall surface $\mathbf{56}_{in}$ and the exterior sidewall surface $\mathbf{56}_{ex}$. The proximal edge of the base member can have an edge thickness defined as the distance between the upper proximal edge $\mathbf{62}_u$ and the lower proximal edge $\mathbf{62}_l$. The flange portion of the base member 22 can have a wall thickness defined as the distance between the upper surface of the flange and the lower surface of the flange. The wall thickness of an element of the base member can be substantially uniform, or can vary. A base member of a contact lens blister package in accordance with the present disclosure can have a maximum wall thickness of 1.00 mm, or 0.90 mm, or 0.85 mm. The base member can have a wall thickness of about 0.8 mm.

The cavities 26 of base members 22 of the present contact lens blister packages are configured to contain a contact lens and a liquid medium, such as, for example, a hydrating liquid, a washing liquid, an extraction liquid, an inspection liquid, a packaging solution, or any combination thereof. The cavity 26 can be of a sufficient size to contain enough liquid medium to completely cover the contact lens present in the cavity 26. The cavity can be of a sufficient size to contain a sufficient amount of liquid medium to keep the contact lens immersed in the liquid for the shelf life of the product. For example, the cavity 26 of the base member 22 can have a volume of from 1.7 milliliters to 2.5 milliliters, or of from 1.9 milliliters to 2.1 milliliters. The blister packages of the present disclosure are intended to be sterilized after filling and sealing, for example, by steam sterilization in an autoclave. As the blister packages are formed of materials which can be affected by high heat and pressure, in one example, the blister packages are not substantially affected by the sterilization process. For example, depending upon the types of materials used to form the components of the blister package and the wall thicknesses used, a blister package may warp when exposed to high heat and pressure. However, in one example, the blister package disclosed herein, for example the blister package 20 comprising a base member 22 having a wall thickness of 0.8 mm or more can remain dimensionally stable (i.e., unwarped) following sterilization. Having the blister packages remain dimensionally stable is particularly important when two or more blister packages are to be stacked, as warping of one or both of the blister packages may make it impossible for the blister packages to stack together as intended, and may result in the stack taking up a greater volume of space than intended, which can increase storage and shipping costs.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the base member 22 has a maximum length L of 47.8 mm, a maximum width W of 30.5 mm, a maximum height H of 9.5 mm, a maximum wall thickness of 1.00 mm, and a maximum cavity volume of 2.5 milliliters, wherein dimensions of the package are substantially the same following autoclaving as before autoclaving.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the base member 22 has a length L of about 47 mm, a width W of about 29 mm, a height H of about 8 mm, a wall thickness of about 0.8 mm, and a cavity volume of from 1.9 milliliters to 2.1 milliliters, wherein dimensions of the package are substantially the same following autoclaving as before autoclaving.

In accordance with the present disclosure, the cavity perimeter 28 of the base member 22 comprises a substantially linear portion and a non-linear portion opposing the substantially linear portion. The substantially linear portion of the cavity perimeter 28 can be located anywhere along the cavity perimeter 28. In the example illustrated in FIG. 5, the substantially linear portion of the cavity perimeter 28 is located in the distal portion of the cavity, i.e., the cavity perimeter 28 comprises a substantially circular distal portion 42 and a substantially linear proximal portion 44. In the illustrated example, as best shown in FIG. 5, the substantially linear proximal portion 44 is also orthogonal to the length L of the base member 22. The presence of the substantially linear portion of the cavity perimeter 28 enables efficient stacking of the blister package 20 with another substantially identical blister package. The example where the substantially linear portion of the cavity perimeter is located in the distal portion of the cavity orthogonal to the length L is a particularly useful example, as further described in connection with FIG. 11. In other examples, the substantially linear portion, including a substantially linear proximal portion 44, may be non-orthogonal to the length L. In alternative examples, the non-linear portion of the cavity perimeter 28 can have an oval, elliptical, tear shaped, or any other appropriate curved configuration. The substantially linear portion 44 can comprises about 10% to about 33% of the perimeter of the cavity. The percentage can be selected to provide a truncated cavity portion that enables inverted reverse stacking with another base member 22, as further discussed herein.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear proximal portion 44 and a non-linear distal portion 42 opposing the substantially linear portion intersecting a length L of the base member extending longitudinally from a distal most end 37 to an opposing proximal edge 35 of the base member; and a plane 59 formed at the intersection of the bottom wall perimeter 54 with the sidewall 50 slopes away from the substantially linear portion of the cavity perimeter 28.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear proximal portion 44 which is substantially orthogonal to a length L of the base member extending longitudinally from a distal most end 37 to an opposing proximal edge 35 of the base member, and a non-linear distal portion 42 opposing the substantially linear portion intersecting the length L of the base member; and a plane 59 formed at the intersection of the bottom wall perimeter 54 with the sidewall 50 slopes away from the substantially linear portion of the cavity perimeter 28.

Figure 9:
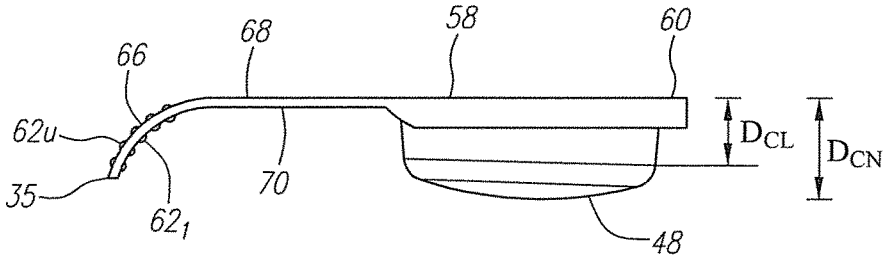
FIG. 9 is a side elevation view of the package of FIG. 5.

As illustrated in FIGS. 7 and 8, the cavity 26 of the base members of the present disclosure comprises a bottom wall 48 having a bottom wall perimeter 54 and a sidewall 50 extending upwardly from the bottom wall perimeter 54 to an upper cavity edge defining a cavity perimeter 28. The intersection of the bottom wall perimeter 54 with the sidewall 50 defines a plane 59, which is illustrated as a line 59 in sectional views of FIGS. 7 and 8. In accordance with the present disclosure, the plane 59 formed at the intersection of the bottom wall perimeter 54 with the sidewall 50 slopes away from the substantially linear portion of the cavity perimeter 28. In other words, the plane 59 slopes toward the non-linear portion of the cavity perimeter 28 opposing the substantially linear portion of the cavity perimeter 28. The slope of plane 59 can be at least 5 degrees, or at least 10 degrees, or at least 15 degrees. Due to the fact that plane 59 slopes away from the linear portion of the cavity perimeter 28 and toward the non-linear (i.e., curved) portion of the cavity perimeter, the cavity is relatively deeper adjacent to the non-linear portion of the perimeter opposing the linear portion than it is adjacent to the linear portion of the perimeter. In the example where the substantially linear portion of the cavity perimeter 28 is a substantially linear proximal portion 44 of the cavity perimeter 28 and the opposing non-linear portion of the cavity perimeter 28 is an opposing non-linear distal portion 42 of the cavity perimeter 28, the cavity depth adjacent to the non-linear portion 42 $D_{CN}$ is greater than the cavity depth adjacent to the linear portion 44 $D_{CL}$, as illustrated in FIG. 9. The slope of the plane 59 formed at the intersection of the bottom wall perimeter 54 and the sidewall 50, and the greater depth of the cavity opposite the linear portion, results in the a contact lens stored in the cavity having a greater likelihood of resting in a position away from the linear portion of the cavity perimeter 28, which can prevent or reduce deformation of the lens caused by the lens resting against the linear portion. In one example, the plane 59 formed at the intersection of the bottom wall 48 and the sidewall 50 is not parallel to a plane defined by the cavity perimeter 28.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein a cavity depth $D_{CL}$ along the substantially linear portion of the cavity perimeter 28 is less than a cavity depth $D_{CN}$ along the opposing non-linear portion of the cavity perimeter 28, and the plane 59 slopes away from the substantially linear portion of the cavity perimeter 28 at an angle of at least 5 degrees. The base member 22 of this example can further comprise a base member 22 having a cavity depth $D_{CL}$ along the substantially linear portion of the cavity perimeter 28 that is 5% less, or 10% less, or 15% less than a cavity depth $D_{CN}$ along the opposing non-linear portion of the cavity perimeter 28.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the base member 22 further comprises a flange 30 extending outwardly from the cavity 26, the flange has a support rib 32 extending from a distal most end of the flange 30, the flange 30 comprises a sealing area 25; a cavity depth $D_{CL}$ along the substantially linear portion of the cavity perimeter 28 is at least 5% less than a cavity depth $D_{CN}$ along the opposing non-linear portion of the cavity perimeter 28, the plane 59 slopes away from the substantially linear portion of the cavity perimeter 28 at an angle of at least 5 degrees, and is not parallel to a plane defined by the cavity perimeter 28. The cavity 26 of the base member 22 of this example can further comprise a light collimating cavity.

The base member 22 of the present disclosure can be configured to allow it to rest in a stable position on a horizontal surface. The base member 22 can be configured to rest in a stable position on a horizontal surface with its cavity 26 opening facing up. In one example, the base member 22 can be configured to rest in a stable position on a horizontal surface with its cavity 26 opening facing up, with both the proximal edge 35 and the bottom wall 48 of the base member 22 directly contacting the horizontal surface. In a particular example, the base member 22 can be configured to rest in a stable position on a horizontal surface with its cavity 26 opening facing up and the bottom wall 48 of the base member 22 directly contacting the horizontal surface, wherein the plane 59 formed at the intersection of the bottom wall 48 and the sidewall 50 is parallel to the horizontal surface. Thus, a contact lens stored in the cavity of a base member 22 of this example can be easily centered in the cavity 26 when the base member 22 is placed on a horizontal surface. This example can be particularly useful when the cavity 26 comprises a light collimation cavity, as it allows the base member 22 to serve as an inspection tray for the lens, and does not require that the base member 22 be placed in a holding tray in order for the bottom wall 48 of the base member 22 to be in a level position during the inspection process.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the cavity 26 comprises a light collimating cavity, and when the blister package is positioned on a horizontal surface with the cavity 26 opening facing up and with both a proximal edge 35 and the bottom wall 48 of the base member 22 contacting the horizontal surface, the plane 59 formed at the intersection of the bottom wall 48 and the sidewall 50 is parallel to the horizontal surface.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the base member 22 further comprises a flange 30 extending outwardly from the cavity 26, the flange has a support rib 32 extending from a distal most end of the flange 30, the flange 30 comprises a sealing area 25, a cavity depth $D_{CL}$ along the substantially linear portion of the cavity perimeter 28 is at least 5% less than a cavity depth $D_{CN}$ along the opposing non-linear portion of the cavity perimeter 28, the plane 59 slopes away from the substantially linear portion of the cavity perimeter 28 at an angle of at least 5 degrees, the cavity 26 comprises a light collimating cavity, and when the blister package is positioned on a horizontal surface with the cavity 26 opening facing up and with both a proximal edge 35 and the bottom wall 48 of the base member 22 contacting the horizontal surface, the plane 59 formed at the intersection of the bottom wall 48 and the sidewall 50 is parallel to the horizontal surface.

An example of the present disclosure is understood to include a contact lens blister package 20 comprising a base member 22 comprising a cavity 26 having a cavity perimeter 28, the cavity perimeter 28 comprising a substantially linear proximal portion 44, the substantially linear proximal portion 44 being orthogonal to a length. L of the base member 22 extending longitudinally from a distal most end 37 to an opposing proximal edge 35 of the base member to enable stacking with a second substantially identical blister package. In one example, the cavity can further comprise a substantially circular distal portion 42 opposing the substantially linear proximal portion 44. However, other shaped distal portions 42 may be incorporated to practice the present devices and methods. In another example, the linear proximal portion 44 comprises about 10% to about 33% of the perimeter of the cavity. In a particular example, the cavity can be a light collimation cavity.

Referring again to FIGS. 4-5, the flange 30 extending from the cavity perimeter 28 comprises a proximal flange portion 46, which extends proximally along the length of the base member from the substantially linear proximal portion 44 to the proximal edge 35, and a distal flange portion 47, which extends distally from the substantially circular distal portion 42 opposing the substantially linear proximal portion 44 to the distal most end 37. In one example, the proximal flange portion 46 has a proximal length $L_P$ that approximates the sum of a length $L_D$ of the distal flange portion 47 and the cavity length $L_C$. The proximal length $L_P$ is sized to match or approximate the sum of the other two lengths $L_C+L_D$ to enable inverted reverse stacking with a second substantially identical blister package, as further discussed below with reference to FIG. 11. In one example, the length. $L_P$ is within +/−10% of the lengths of $L_C+L_D$.

As disclosed herein, the base members 22 of the present contact lens blister packages can be configured to allow the blister packages to be stacked in a sturdy, compact arrangement with each other. A preferred packaging arrangement for the present blister packages is the inverted reverse arrangement, discussed below in relation to FIG. 11. In one example, the present base members 22 are configured to allow stacking in the inverted reverse arrangement such that a stack of two blister packages has a length and width approximately the same as, or less than 5% larger than a single blister package, and the stack has a height less than 1.5 times the height of a single blister package. The present base members can be configured to allow stacking in the inverted reverse arrangement such that a stack of two strips of blister packages has a length and width approximately the same as, or less than 5% larger than a single strip of blister packages, and a height less than 1.5 times the height of a single strip of blister packages. The present base member can be configured to enable stacking of two contact lens blister packages in a volume of space having a height of from 1.0 to 1.25 times a height H of a single blister package 20, a length of from 1.0 to 1.25 times a length L of the single blister package 20, and a width of from 1.0 to 1.25 times a width W of the single blister package 20. In another example, the base member can be configured to enable stacking of two contact lens blister packages in a volume of space having a height of from 1.0 to 1.1 times a height H of a single blister package 20, a length approximately the same as the length L of the single blister package 20, and a width approximately the same as the width W of the single blister package 20.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the base member 22*a* of the first contact lens blister package 20*a* is configured to enable stacking against a second substantially identical contact lens blister package 20*b* in an inverted reverse arrangement to form a stack of two substantially identical contact lens blister packages having a height of from 1.0 to 1.25 times a height H of the first blister package 20*a*, a length of from 1.0 to 1.25 times a length L of the first blister package 20*a*, and a width of from 1.0 to 1.25 times a width W of the first blister package 20*a*.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the base member 22 further comprises a flange 30 extending outwardly from the cavity 26, the flange has a support rib 32 extending from a distal most end of the flange 30, the flange 30 comprises a sealing area 25, a cavity depth $D_{CL}$ along the substantially linear portion of the cavity perimeter 28 is at least 5% less than a cavity depth $D_{CN}$ along the opposing non-linear portion of the cavity perimeter 28, the plane 59 slopes away from the substantially linear portion of the cavity perimeter 28 at an angle of at least 5 degrees, the cavity 26 comprises a light collimating cavity, and when the blister package is positioned on a horizontal surface with the cavity 26 opening facing up and with both a proximal edge 35 and the bottom wall 48 of the base member 22 contacting the horizontal surface, the plane 59 formed at the intersection of the bottom wall 48 and the sidewall 50 is parallel to the horizontal surface, and wherein the base member 22*a* of the first contact lens blister package 20*a* is configured to enable stacking against a second substantially identical contact lens blister package 20*b* in an inverted reverse arrangement to form a stack of two substantially identical contact lens blister packages having a height of from 1.0 to 1.1 times a height H of the first blister package 20*a*, a length of from 1.0 to 1.1 times a length L of the first blister package 20*a*, and a width of from 1.0 to 1.2 times a width W of the first blister package 20*a*.

Thus, another example of the present disclosure comprises a blister package 20 comprising a base member 22 having a proximal most edge 35 and a distal most end 37 opposing the proximal most edge 35, the base member 22 comprising a cavity 26 having a length $L_C$, a cavity perimeter defined by a substantially linear portion, for example a substantially linear proximal portion 44, and a flange 30 extending from the cavity 26. When the substantially linear portion of the cavity perimeter comprises a substantially linear proximal portion 44 of the cavity perimeter, the flange 30 comprises a proximal flange portion 46 extending proximally along the length of the base member L from the substantially linear proximal portion 44 to the proximal most edge 35 and a distal flange portion 47 extending distally from a distal cavity portion opposing the substantially linear proximal portion 44 to the distal most end 37. In an example, the proximal flange portion 46 has a length that approximates the sum of a length of the distal flange portion 47 and the cavity length $L_C$ to enable inverted reverse stacking with a second substantially identical blister package. The package assembly as disclosed herein is also understood to include two blister packages each comprising a proximal flange section 46 comprising an upper surface and a lower surface, a cavity 26 with a substantially linear cavity perimeter portion, for example a substantially linear proximal portion 44, an exterior cavity sidewall, and an exterior cavity bottom, and wherein when the two blister packages are stacked in an inverted reverse stacking arrangement in which the exterior cavity bottom of one base member touches the lower surface of the proximal flange section of the other blister package, the two exterior proximal cavity sidewalls contact one another.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the base member 22*a* of the first contact lens blister package 20*a* is configured to enable stacking against a second substantially identical contact lens blister package 20*b* in an inverted reverse arrangement to form a stack of two blister packages having a line contact between a linear sidewall portion of the first base member 22*a* and a linear sidewall portion of the second base member 22*b*.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the base member 22 further comprises a flange 30 extending outwardly from the cavity 26, the flange has a support rib 32 extending from a distal most end of the flange 30, the flange 30 comprises a sealing area 25, a cavity depth $D_{CL}$ along the substantially linear portion of the cavity perimeter 28 that is at least 5% less than a cavity depth $D_{CN}$ along the opposing non-linear portion of the cavity perimeter 28, the plane 59 slopes away from the substantially linear portion of the cavity perimeter 28 at an angle of at least 5 degrees, the cavity 26 comprises a light collimating cavity, and when the blister package is positioned on a horizontal surface with the cavity 26 opening facing up and with both a proximal edge 35 and the bottom wall 48 of the base member 22 contacting the horizontal surface, the plane 59 formed at the intersection of the bottom wall 48 and the sidewall 50 is parallel to the horizontal surface, and wherein the base member 22*a* of the first contact lens blister package 20*a* is configured to enable stacking against a second substantially identical contact lens blister package 20*b* in an inverted reverse arrangement to form a stack of two substantially identical contact lens blister packages having a height of from 1.0 to 1.1 times a height H of the first blister package 20*a*, a length of from 1.0 to 1.1 times a length L of the first blister package 20*a*, and a width of from 1.0 to 1.2 times a width W of the first blister package 20*a*; and the base member 22*a* of the first contact lens blister package 20*a* is configured to enable stacking against a second substantially identical contact lens blister package 20*b* in an inverted reverse arrangement to form a stack of two blister packages having a line contact between a linear sidewall portion of the first base member 22*a* and a linear sidewall portion of the second base member 22*b*.

With reference again to FIGS. 7-8, the cavity 26 comprises a bottom wall 48 and a sidewall 50. The bottom wall 48 comprises a bottom wall surface 52 and a bottom wall perimeter 54. The bottom wall surface 52 comprises exterior and interior wall surfaces $\mathbf{52}_{ex}$, $\mathbf{52}_{in}$ and the bottom wall perimeter 54 comprises exterior and interior sides $\mathbf{54}_{ex}$ and $\mathbf{54}_{in}$. The sidewall 50 extends upwardly from the bottom wall perimeter 54 to the top of the cavity perimeter 28 and has a sidewall surface 56 comprising an exterior surface $\mathbf{56}_{ex}$ and an interior surface $\mathbf{56}_{in}$. In the example illustrated in FIG. 7, the sidewall surface 56 comprises a proximal sidewall portion 58 that depends from the substantially linear proximal portion 44 of the cavity perimeter and a distal sidewall portion 60 that depends from the non-linear distal portion 42 of the cavity perimeter. In one example, the cavity 26 is configured such that the proximal sidewall portion 58 forms a line contact 72 (FIG. 11), as opposed to a single point contact, with a proximal sidewall portion 58 of a second substantially identical base member 22 of a blister package 20 stacked in an inverted reverse arrangement, as further discussed below with reference to FIG. 11. This line contact formed between two substantially identical base members 22 when they are stacked in an inverted reverse arrangement enables the present devices and methods to feature tightly packed blister packages that are suitable for stacking in a storage container for shipping, including bulk shipping of the packages to distributors, as well as shipping of one or more individual blister packages directly to a consumer through standard mail and package delivery services.

Thus, in one example, the present disclosure is directed to a contact lens blister package 20 comprising a thermoplastic base member 22 having a cavity 26, the cavity 26 comprising a bottom wall surface 52 and a sidewall surface 56 extending perimetrically from the bottom wall surface 52 to an upper cavity edge defining a cavity perimeter 28, the sidewall surface 56 comprising a proximal sidewall portion 58 and an opposing distal sidewall portion 60, wherein the proximal sidewall portion 58 forms a line contact with a proximal sidewall portion 58 of a second substantially identical blister package stacked with the first blister package in an inverted reverse arrangement.

In one example, the cavity perimeter 28 is larger in size or dimension than the bottom wall perimeter 54. Thus, the sidewall surface 56 extending upwardly from the bottom wall perimeter 54 to the cavity perimeter 28 can have an upward slope. In one example, the sidewall surface 56 varies in slope. For example, the slope of the proximal sidewall portion 58 may be different from the slope of the distal sidewall portion 60. In another example, the proximal sidewall portion 58 and the distal sidewall portion 60 can have the same slope. The slope can also be variable rather than constant. In another example, the proximal sidewall portion 58 is straight, i.e., has no slope. In another example, the cavity perimeter 28 can be equal to the bottom wall perimeter 54 and the sidewall surface 56 can be flat, i.e., it has no slope. In an alternative example, the sidewall surface 56 can be curved and the cavity perimeter 28 can be the same as the bottom wall perimeter 54.

Referring again to FIGS. 4 and 7, the flange 30 extends outwardly from the cavity 26 and has a support rib 32 extending from a distal most end of the flange 30. The support rib 32 has angles $\mathbf{57}_p$ and $\mathbf{57}_d$ at the proximal and distal sides, respectively. In some examples, the angle $\mathbf{57}_p$ can be either acute or obtuse. In some examples, the angle $\mathbf{57}_p$ is between about 80 degrees and about 110 degrees. In one example, the angle $\mathbf{57}_p$ is between about 85° and about 90°.

As illustrated in FIGS. 7 and 8, the bottom wall surface 52 of the cavity 26 can be curved outwardly relative to the central cavity space. In one example, the bottom wall interior surface $\mathbf{52}_{in}$ can be configured to allow a contact lens disposed in the cavity to be easily centered. For example, the bottom wall surface $\mathbf{52}_{in}$ can be curved.

In the example where the cavity 26 of the base member 22 comprises a light collimation cavity, the bottom wall 48, including the bottom wall interior surface $\mathbf{52}_{in}$ and the bottom wall external surface $\mathbf{52}_{ex}$, can be configured to provide a collimation cavity in conjunction with the hydrated contact lens and the packaging solution present in the cavity 26 of the base member 22. For example, the bottom wall surface $\mathbf{52}_{in}$ can have a radius of curvature that is at least twice as large as the base curve of the hydrated contact lens located in the cavity. For example, the radius of curvature can be at least 200% larger, at least 300% larger, or at least 400% larger than the base curve of the hydrated contact lens. For example, if a hydrated contact lens has a base curve of about 8 mm, the radius of curvature of the bottom wall surface $\mathbf{52}_{in}$ can be at least 16 mm, or at least 24 mm, or at least 32 mm. In another example, the radius of curvature of the bottom wall surface $\mathbf{52}_{in}$ can be from about 15 mm to about 40 mm. In another example, the radius of curvature of the bottom wall surface 52*b* can be between 28 mm to about 31 mm. In yet another example, the radius of curvature can vary between the length $L_C$ and the width $W_C$ of the cavity 26. In an alternative example, the radius of curvature can be identical along the length $L_C$ and along the width $W_C$ of the cavity 26.

Figure 10:
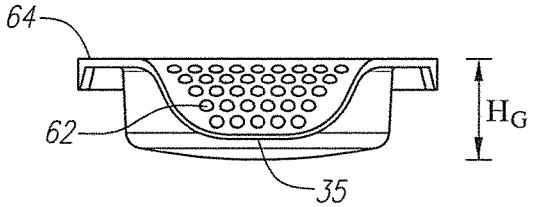
FIG. 10 is a front elevation view of the package of FIG. 5.

FIGS. 9 and 10 show a side and front elevation view, respectively, of the base member 22. As best illustrated in FIG. 9, the gripping portion 62 curves downwardly from a generally planar proximal gripping flange section 64 to the proximal edge 35, which in conjunction with the bottom wall 48 stabilizes the base member 22 on a flat surface. In one example, the gripping portion 62 comprises an upper gripping portion $\mathbf{62}_u$ and a lower gripping portion $\mathbf{62}_l$. In one example, the lower gripping portion $\mathbf{62}_l$ is configured such that its curvature accommodates, at least in part, a bottom wall and a distal flange portion of another substantially identical and inversely stacked blister package, as further described in connection with FIG. 11.

In one example, the gripping portion 62 comprises raised bumps or protrusions 66 for gripping purposes and/or aesthetic appeal. The bumps 66 are formed in an orderly spaced array. In another example, the bumps 66 are randomly formed. In the illustrated example, the raised bumps or protrusions 66 are provided on both a first side 68 and a second side 70 of the gripping portion 62, which correspond to the upper and lower gripping portions $\mathbf{62}_u$ and $\mathbf{62}_l$. In alternative examples, the protrusions 66 are provided only on the first side 68 or the second side 70, but not both. When provided on both sides, the number of bumps can be the same on either side or different.

The gripping portion 62 comprises a height $H_G$ measured from the proximal gripping flange section 64 to the proximal edge 35, along a vertical line, and a length $L_G$ (FIG. 5) measured from the proximal gripping flange section 64 to the proximal edge 35, along a lengthwise direction of the base member, as best illustrated in FIGS. 5 and 10. In one example, the gripping portion 62 is configured, such as sized and shaped, to enable efficient packaging. For example, when stacked in an inverted reverse arrangement with a substantially identical blister package, the gripping portion 62 does not extend too far nor has excessive overhang portions that can take up packaging space. In one example, the height $H_G$ of the gripping portion 62 can range from about 3 mm to about 8 mm. In a particular example, the height $H_G$ of the gripping portion 62 is about 6.5 mm. In another example, the height $H_G$ of the gripping portion 62 is about 4.5 mm. In yet another example, the height $H_G$ of the gripping portion 62 is about 5.9 mm. The length $L_G$ of the gripping portion 62 can be variable. In one example, the length $L_G$ of the gripping portion 62 can range from about 45 mm to about 50 mm. In one example, the gripping portion 62 is about 47.1 mm long. In an alternative example, the gripping portion 62 is about 46.3 mm long. In yet another example, the length of the gripping portion 62 is about 46.9 mm. In one example, the base member 22 is configured, such as sized and shaped, so that it can be stacked against another substantially identical base member in an inverted reverse arrangement, as shown in FIG. 11, and as described herein.

Figure 11:
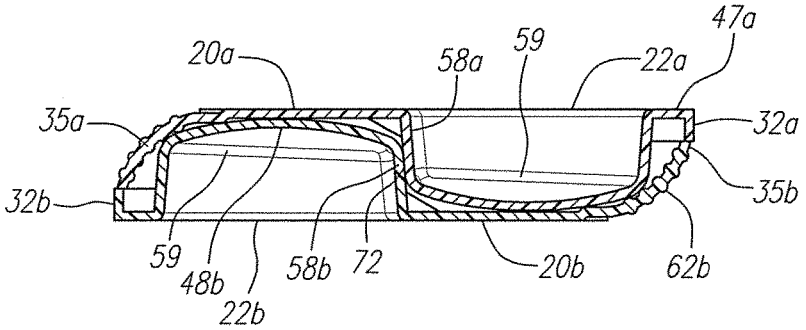
FIG. 11 is a cross-sectional side view of two contact lens packages stacked in an inverted reverse arrangement relative to one another.

FIG. 11 shows a first base member 22*a* stacked against a substantially identical second base member 22*b* in an inverted reverse arrangement. In this arrangement, the second base member or blister package is inverted relative to the position of the first base member or blister package, and is also reversed relative to the position of the first base member or blister package. The second base member or blister package is then placed directly on top the first base member or blister package, with the bottom surface of the first base member in direct contact with the bottom surface of the second base member. In other words, when two substantially identical base members or blister packages are stacked in this inverted reverse arrangement, the top surface of the first base member is not in contact with the bottom surface of the second base member, the sealing member of the first blister package is not in contact with the bottom surface of the second base member or blister package, and the sealing member of the first blister package is not in contact with the sealing member of the second blister package. For convenience, the description with reference to FIG. 11 is sometimes limited to components of either the first base member 22*a* or the second base member 22*b* but is understood to apply equally to the other base member and more generally to the base member 22 discussed elsewhere herein for the present devices and methods.

FIG. 11 illustrates two stacked base members or blister packages wherein, the bottom wall 48*a* of the first base member 22*a* abuts at least a portion of the second side 70*b* of the proximal flange portion 46*b* of the second base member 22*b*. In another example, the proximal sidewall portion 58*a* of the first base member 22*a* abuts the proximal sidewall portion 58*b* of the inversely stacked second base member 22*b*. In one specific example, the proximal sidewall portion 58*a* forms a line contact 72 with the proximal sidewall portion 58*b* of the inversely stacked base member 22*b*. In one example, a lower gripping portion $\mathbf{62}_{lb}$ of the base member 22*b* is configured such that its curvature allows a proximal edge 35*b* to abut a support rib 32*a* extending from a distal flange portion 47*a* of the first base member 22*a*. Thus, as shown, the pair of reversed and inverted stack blister packages comprises two cavities having a line contact 72 therebetween and two sets of edge contacts: (1) between a support rib 32*a* and a proximal edge 35*b* and (2) between a support rib 32*b* and a proximal edge 35*a*, as shown in FIG. 11. In one example of the devices and methods disclosed herein, a stack of two substantially identical blister packages or base members can comprise one or more of these points of contact, namely, a line contact between a linear sidewall portion of a first base member and a linear sidewall portion of a second base member (e.g., between a linear proximal sidewall portion 58*a* of a first base member 22*a* and a linear sidewall portion 58*b* of a second base member 22*b*); or an edge contact between a support rib 32*a* of a first base member 22*a* and a proximal edge 35*b* of a second base member 22*b*; or an edge contact between a proximal edge 35*a* of a first base member 22*a* and a support rib 32*b* of a second base member 22*b*, or any combination thereof.

One example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28, wherein the base member 22*a* of the first contact lens blister package 20*a* is configured to enable stacking against a second substantially identical contact lens blister package 20*b* in an inverted reverse arrangement to form a stack of two blister packages having at least one type of contact between the base member 22*a* of the first contact lens blister package 20*a* and a base member 22*b* of the second blister package 20*b*, wherein the at least one type of contact is a line contact between a linear sidewall portion of the first base member 22*a* and a linear sidewall portion of the second base member 22*b*, or an edge contact between a support rib 32*a* of the first base member 22*a* and a proximal edge 35*b* of the second base member 22*b*, or an edge contact between a proximal edge 35*a* of the first base member 22*a* and a support rib 32*b* of the second base member 22*b*, or any combination thereof.

Another example of a contact lens blister package in accordance with the present disclosure comprises: a thermoplastic base member 22 comprising a proximal end region 34 having a grip portion 62, a distal end region 36, a first side region 38 extending from the proximal end region 34 to the distal end region 36, a second side region 40 opposing the first side region 38, and a cavity 26 configured to contain a packaging solution and a contact lens, the cavity 26 being located between the proximal end region 34 and the distal end region 36 and between the first side region 38 and the second side region 40; wherein the cavity 26 comprises a bottom wall 48 having a bottom wall perimeter 54 and a sidewall 50 extending upwardly from the bottom wall perimeter 54 to an upper cavity edge defining a cavity perimeter 28; the cavity perimeter 28 comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28; wherein the base member 22 further comprises a flange 30 extending outwardly from the cavity 26, the flange has a support rib 32 extending from a distal most end of the flange 30, the flange 30 comprises a sealing area 25, a cavity depth $D_{CL}$ along the substantially linear portion of the cavity perimeter 28 is at least 5% less than a cavity depth $D_{CN}$ along the opposing non-linear portion of the cavity perimeter 28, the plane 59 slopes away from the substantially linear portion of the cavity perimeter 28 at an angle of at least 5 degrees, the cavity 26 comprises a light collimating cavity, and when the blister package is positioned on a horizontal surface with the cavity 26 opening facing up and with both a proximal edge 35 and the bottom wall 48 of the base member 22 contacting the horizontal surface, the plane 59 formed at the intersection of the bottom wall 48 and the sidewall 50 is parallel to the horizontal surface, and wherein the base member 22*a* of the first contact lens blister package 20*a* is configured to enable stacking against a second substantially identical contact lens blister package 20*b* in an inverted reverse arrangement to form a stack of two substantially identical contact lens blister packages having a height of from 1.0 to 1.1 times a height H of the first blister package 20*a*, a length of from 1.0 to 1.1 times a length L of the first blister package 20*a*, and a width of from 1.0 to 1.2 times a width W of the first blister package 20*a*; and the base member 22*a* of the first contact lens blister package 20*a* is configured to enable stacking against a second substantially identical contact lens blister package 20*b* in an inverted reverse arrangement to form a stack of two blister packages having at least one type of contact between the base member 22*a* of the first contact lens blister package 20*a* and a base member 22*b* of the second blister package 20*b*, wherein the at least one type of contact is a line contact between a linear sidewall portion of the first base member 22*a* and a linear sidewall portion of the second base member 22*b*, or an edge contact between a support rib 32*a* of the first base member 22*a* and a proximal edge 35*b* of the second base member 22*b*, or an edge contact between a proximal edge 35*a* of the first base member 22*a* and a support rib 32*b* of the second base member 22*b*, or any combination thereof.

Thus, in one example of the present package and device, therefore, are directed toward a contact lens package assembly, comprising a first contact lens package 20*a* and a second contact lens package 20*b* which is substantially identical to the first contact lens package 20*a*, and which is stacked in an inverted reverse arrangement against the first contact lens package 20*a*. In the contact lens package assembly, each of the first contact lens package 20*a* and second contact lens package 20*b* comprising a thermoplastic base member 22 comprising a packaging solution and a contact lens located in a cavity 26; the cavity 26 comprising a sidewall 50 extending from a bottom wall 48 to a cavity edge defining the cavity perimeter 28, the sidewall comprising a proximal sidewall portion 58 and an opposing distal sidewall portion 60; and a flange 30 extending outwardly from the cavity 26 and having a sealing area 25 to which a sealing member 24 can be attached to seal the cavity. The flange 30 includes a proximal flange portion 46 extending along a length of the base member 22 from a proximal end of the cavity to a proximal edge 35 of the thermoplastic base member; the proximal flange portion 46 having a first side contiguous with the cavity perimeter 28 and a second side opposing the first side; wherein the proximal sidewall portion 58*a* of the first contact lens package 20*a* abuts a proximal sidewall portion 58*b* of the second contact lens package 29*b*, and the bottom wall 50*a* of the first contact lens package 20*a* abuts a portion of a second side of the proximal flange portion 46*b* of the second contact lens package 20*b*. In an example, the sealing area 25 comprises a band circumscribing the cavity 26. The sealing area 25 may have the same configuration or shape as the perimeter of the cavity 28. In alternative examples, the sealing area 25 can be round, oval, tear drop, irregular, or round with a proximally extending projection. The sealing area 25 may comprise a uniform width or a varying width.

In another example of the present assembly, the proximal sidewall portion 58*a* of the first contact lens package 20*a* forms a line contact with the proximal sidewall portion 58*b* of the second contact lens package 20*b* when the first contact lens package 20*a* and the second contact lens package are stacked in an inverted reverse arrangement.

The present disclosure is also directed to a contact lens package assembly. In accordance with the present disclosure, a contact lens package assembly comprises: a first blister package 20*a* and a second blister package 20*b*, wherein the second blister package 20*b* is substantially identical to the first blister package 20*a*; the first blister package 20*a* and the second blister package 20*b* each comprises a thermoplastic base member 22*a*, 22*b* as disclosed herein; and the base member 22*a* of the first blister package 20*a* and the base member 22*b* of the second blister package 20*b* are configured such that the second base member 22*b* is stackable against the first base member 22*a* in an inverted reverse arrangement.

One example of a contact lens package assembly in accordance with the present disclosure comprises: a first blister package 20*a* and a second blister package 20*b*, wherein the second blister package 20*b* is substantially identical to the first blister package 20*a*; the first blister package 20*a* and the second blister package 20*b* each comprises a thermoplastic base member 22*a*, 22*b* comprising a proximal end region 34*a*, 34*b* having a grip portion 62*a*, 62*b*; a distal end region 36*a*, 36*b*; a first side region 38*a*, 38*b* extending from the proximal end region 34*a*, 34*b* to the distal end region 36*a*, 36*b*; a second side region 40*a*, 40*b* opposing the first side region 38*a*; 38*b*; and a cavity 26*a*, 26*b* configured to contain a packaging solution and a contact lens, the cavity 26*a*, 26*b* being located between the proximal end region 34*a*, 34*b* and the distal end region 36*a*, 36*b* and between the first side region 38*a*, 38*b* and the second side region 40*a*, 40*b*; the cavity 26*a*, 26*b* comprises a bottom wall 48*a*, 48*b* having a bottom wall perimeter 54*a*, 54*b* and a sidewall 50*a*, 50*b* extending upwardly from the bottom wall perimeter 54*a*, 54*b* to an upper cavity edge defining a cavity perimeter 28*a*, 28*b*; the cavity perimeter 28*a*, 28*b* comprises a substantially linear portion and a non-linear portion opposing the substantially linear portion; and a plane 59*a*, 59*b* formed at the intersection of the bottom wall perimeter 54*a*, 54*b* and the sidewall 50*a*, 50*b* slopes away from the substantially linear portion of the cavity perimeter 28*a*, 28*b*; and the base member 22*a* of the first blister package 20*a* and the base member 22*b* of the second blister package 20*b* are configured such that the second base member 22*b* is stackable against the first base member 22*a* in an inverted reverse arrangement; wherein the cavities 26*a*, 26*b* of the base members 22*a*, 22*b* comprise light collimating cavities.

In a particular example of the package assembly, the linear sidewall portion of the base member 22*a* can form a line contact 72 with the linear sidewall portion of the stacked second base member 22*b*. For example, the package assembly can comprise: a first blister package 20*a* and a second blister package 20*b*, wherein the second blister package 20*b* is substantially identical to the first blister package 20*a*; the first blister package 20*a* and the second blister package 20*b* each comprises a thermoplastic base member 22*a*, 22*b* comprising a proximal end region 34*a*, 34*b* having a grip portion 62*a*, 62*b*; a distal end region 36*a*, 36*b*; a first side region 38*a*, 38*b* extending from the proximal end region 34*a*, 34*b* to the distal end region 36*a*, 36*b*; a second side region 40*a*, 40*b* opposing the first side region 38*a*; 38*b*; and a cavity 26*a*, 26*b* configured to contain a packaging solution and a contact lens, the cavity 26*a*, 26*b* being located between the proximal end region 34*a*, 34*b* and the distal end region 36*a*, 36*b* and between the first side region 38*a*, 38*b* and the second side region 40*a*, 40*b*; the cavity 26*a*, 26*b* comprises a bottom wall 48*a*, 48*b* having a bottom wall perimeter 54*a*, 54*b* and a sidewall 50*a*, 50*b* extending upwardly from the bottom wall perimeter 54*a*, 54*b* to an upper cavity edge defining a cavity perimeter 28*a*, 28*b*; the cavity perimeter 28*a*, 28*b* comprises a substantially linear portion and a non-linear portion opposing the substantially linear portion; and a plane 59*a*, 59*b* formed at the intersection of the bottom wall perimeter 54*a*, 54*b* and the sidewall 50*a*, 50*b* slopes away from the substantially linear portion of the cavity perimeter 28*a*, 28*b*; and the base member 22*a* of the first blister package 20*a* and the base member 22*b* of the second blister package 20*b* are configured such that the second base member 22*b* is stackable against the first base member 22*a* in an inverted reverse arrangement, wherein the linear sidewall portion of the first base member 22*a* forms a line contact 72 with the linear sidewall portion of the stacked second base member 22*b*.

In another example, the package assembly can comprise: a first blister package 20*a* and a second blister package 20*b*, wherein the second blister package 20*b* is substantially identical to the first blister package 20*a*; the first blister package 20*a* and the second blister package 20*b* each comprises a thermoplastic base member 22*a*, 22*b* comprising a proximal end region 34*a*, 34*b* having a grip portion 62*a*, 62*b*; a distal end region 36*a*, 36*b*; a first side region 38*a*, 38*b* extending from the proximal end region 34*a*, 34*b* to the distal end region 36*a*, 36*b*; a second side region 40*a*, 40*b* opposing the first side region 38*a*; 38*b*; and a cavity 26*a*, 26*b* configured to contain a packaging solution and a contact lens, the cavity 26*a*, 26*b* being located between the proximal end region 34*a*, 34*b* and the distal end region 36*a*, 36*b* and between the first side region 38*a*, 38*b* and the second side region 40*a*, 40*b*; the cavity 26*a*, 26*b* comprises a bottom wall 48*a*, 48*b* having a bottom wall perimeter 54*a*, 54*b* and a sidewall 50*a*, 50*b* extending upwardly from the bottom wall perimeter 54*a*, 54*b* to an upper cavity edge defining a cavity perimeter 28*a*, 28*b*; the cavity perimeter 28*a*, 28*b* comprises a substantially linear proximal portion 44*a*, 44*b* and a non-linear distal portion 42*a*, 42*b* opposing the substantially linear proximal portion 44*a*, 44*b*; and a plane 59*a*, 59*b* formed at the intersection of the bottom wall perimeter 54*a*, 54*b* and the sidewall 50*a*, 50*b* slopes away from the substantially linear portion of the cavity perimeter 28*a*, 28*b*; and the base member 22*a* of the first blister package 20*a* and the base member 22*b* of the second blister package 20*b* are configured such that the second base member 22*b* is stackable against the first base member 22*a* in an inverted reverse arrangement, wherein the linear proximal sidewall portion 44*a* of the first base member 22*a* forms a line contact 72 with the linear proximal sidewall portion 44*b* of the stacked second base member 22*b*.

In another example, the package assembly can comprise: a first blister package 20*a* and a second blister package 20*b*, wherein the second blister package 20*b* is substantially identical to the first blister package 20*a*; the first blister package 20*a* and the second blister package 20*b* each comprises a thermoplastic base member 22*a*, 22*b* comprising a proximal end region 34*a*, 34*b* having a grip portion 62*a*, 62*b*; a distal end region 36*a*, 36*b*; a first side region 38*a*, 38*b* extending from the proximal end region 34*a*, 34*b* to the distal end region 36*a*, 36*b*; a second side region 40*a*, 40*b* opposing the first side region 38*a*; 38*b*; and a cavity 26*a*, 26*b* configured to contain a packaging solution and a contact lens, the cavity 26*a*, 26*b* being located between the proximal end region 34*a*, 34*b* and the distal end region 36*a*, 36*b* and between the first side region 38*a*, 38*b* and the second side region 40*a*, 40*b*; the cavity 26*a*, 26*b* comprises a bottom wall 48*a*, 48*b* having a bottom wall perimeter 54*a*, 54*b* and a sidewall 50*a*, 50*b* extending upwardly from the bottom wall perimeter 54*a*, 54*b* to an upper cavity edge defining a cavity perimeter 28*a*, 28*b*; the cavity perimeter 28*a*, 28*b* comprises a substantially linear proximal portion 44*a*, 44*b* and a non-linear distal portion 42*a*, 42*b* opposing the substantially linear proximal portion 44*a*, 44*b*; and a plane 59*a*, 59*b* formed at the intersection of the bottom wall perimeter 54*a*, 54*b* and the sidewall 50*a*, 50*b* slopes away from the substantially linear portion of the cavity perimeter 28*a*, 28*b*; the base member 22*a* of the first blister package 20*a* and the base member 22*b* of the second blister package 20*b* are configured such that the second base member 22*b* is stackable against the first base member 22*a* in an inverted reverse arrangement, wherein the linear proximal sidewall portion 44*a* of the first base member 22*a* forms a line contact 72 with the linear proximal sidewall portion 44*b* of the stacked second base member 22*b*; the cavity 26*a* of the first base member 22*a* and the cavity 26*b* of the second base member 22*b* each contain a contact lens and packaging solution, and a sealing member 24*a*, 24*b* removably attached to a sealing area 25*a*, 25*b* of each base member 22*a*, 22*b*.

In another example, the package assembly can comprise: a first blister package 20*a* and a second blister package 20*b*, wherein the second blister package 20*b* is substantially identical to the first blister package 20*a*; the first blister package 20*a* and the second blister package 20*b* each comprises a thermoplastic base member 22*a*, 22*b* comprising a proximal end region 34*a*, 34*b* having a grip portion 62*a*, 62*b*; a distal end region 36*a*, 36*b*; a first side region 38*a*, 38*b* extending from the proximal end region 34*a*, 34*b* to the distal end region 36*a*, 36*b*; a second side region 40*a*, 40*b* opposing the first side region 38*a*; 38*b*; and a cavity 26*a*, 26*b* configured to contain a packaging solution and a contact lens, the cavity 26*a*, 26*b* being located between the proximal end region 34*a*, 34*b* and the distal end region 36*a*, 36*b* and between the first side region 38*a*, 38*b* and the second side region 40*a*, 40*b*; the cavity 26*a*, 26*b* comprises a bottom wall 48*a*, 48*b* having a bottom wall perimeter 54*a*, 54*b* and a sidewall 50*a*, 50*b* extending upwardly from the bottom wall perimeter 54*a*, 54*b* to an upper cavity edge defining a cavity perimeter 28*a*, 28*b*; the cavity perimeter 28*a*, 28*b* comprises a substantially linear proximal portion 44*a*, 44*b* and a non-linear distal portion 42*a*, 42*b* opposing the substantially linear proximal portion 44*a*, 44*b*; and a plane 59*a*, 59*b* formed at the intersection of the bottom wall perimeter 54*a*, 54*b* and the sidewall 50*a*, 50*b* slopes away from the substantially linear portion of the cavity perimeter 28*a*, 28*b*; the base member 22*a* of the first blister package 20*a* and the base member 22*b* of the second blister package 20*b* are configured such that the second base member 22*b* is stackable against the first base member 22*a* in an inverted reverse arrangement, wherein the linear proximal sidewall portion 44*a* of the first base member 22*a* forms a line contact 72 with the linear proximal sidewall portion 44*b* of the stacked second base member 22*b*; the cavity 26*a* of the first base member 22*a* and the cavity 26*b* of the second base member 22*b* each contain a contact lens and packaging solution, and a sealing member 24*a*, 24*b* removably attached to a sealing area 25*a*, 25*b* of each base member 22*a*, 22*b*; and wherein the first base member 22*a* and the second base member 22*b* each further comprises a support rib 32*a*, 32*b* extending from a distal most end 37*a*, 37*b* of the base member 22*a*, 22*b*, the proximal edge 35*a* of the first base member 22*a* abuts the support rib 32*b* of the stacked second base member 22*b* when the first base member 22*a* and the second base member 22*b* are stacked in an inverted reverse arrangement; and dimensions of both the first contact lens package 20*a* and the second contact lens package 20*b* are substantially the same following autoclaving as before autoclaving, and the first base member 22*a* and the second base member 22*b* are stackable in the inverted reverse arrangement following autoclaving.

The present packages and arrays of packages can be made using conventional methods known to persons of ordinary skill in the art. For example, the base members 22 of the packages and package arrays can be injection molded from thermoplastic resin materials in an injection molding machine. A contact lens packaging solution can be dispensed into the cavities of the base members 22, and contact lenses placed into the packaging solution, with one contact lens per cavity. Alternatively, the contact lens can be placed into the cavity and the packaging solution added after the placement of the contact lens into the cavity. The sealing member 24 can then be applied to the sealing area 25 of the base member 22 to seal the packaging solution and contact lens in the cavity 26. The sealed package containing the hydrated contact lens and the packaging solution can then be sterilized and prepared for distribution.

The present disclosure is further understood to include a method for manufacturing a packaged contact lens. The method of manufacturing a packaged contact lens comprises: providing a demolded and delensed polymeric contact lens body; placing the contact lens body in a thermoplastic base member 22 of a contact lens blister package 20 with a packaging solution; and sealing the contact lens blister package with a sealing member 24. In accordance with the present method, the base member 22 comprises a proximal end region 34 having a grip portion 62, a distal end region 36, a first side region 38 extending from the proximal end region 34 to the distal end region 36, a second side region opposing the first side region 38, and a cavity 26 configured to contain a packaging solution and a contact lens. The cavity 26 of the base member 22 is located between the proximal end region 34 and the distal end region 36 and between the first side region 38 and the second side region 40, and the cavity 26 comprises a bottom wall 48 having a bottom wall perimeter 54 and a sidewall 50 extending upwardly from the bottom wall perimeter 54 to an upper cavity edge defining a cavity perimeter 28. The cavity perimeter 28 of the base member comprises a substantially linear portion and a non-linear portion opposing the substantially linear portion; and a plane 59 formed at the intersection of the bottom wall perimeter 54 with the sidewall 50 slopes away from the substantially linear portion of the cavity perimeter 28. Thus, the blister package of the method of manufacturing can comprise any of the blister packages disclosed herein. In one example, the method can further comprise the step of sterilizing the sealed blister package. In another example, the method can further comprise the step of providing a plurality of demolded and delensed contact lenses, placing each of the plurality of lenses in an individual contact lens blister package, and forming an array of contact lens blister packages following sealing each individual contact lens blister package. The method of manufacturing of the present disclosure can also further comprise molding a polymerizable composition in a lens mold to form a polymerized contact lens; separating the lens mold into a first mold half and a second mold half so that the polymerized contact lens is attached to either the first mold half or the second mold half; delensing the polymerized contact lens from the first mold half or the second mold half, either by dry delensing or wet delensing; washing the delensed polymerized contact lens; packaging the washed polymerized contact lens in a blister package as disclosed herein, inspecting the contact lens for potential defects, and then sealing the blister package with a sealing member. In one specific example, the blister package can be inspected using an automatic inspection procedure as described and illustrated in the '366 patent.

With the devices and methods described herein, it is possible to contain a contact lens in a cavity having a perimeter which includes a linear portion while reducing the potential for a contact lens stored in the cavity to suffer deformation caused by the lens resting against the linear portion of the blister package for extended periods of time. By making the plane formed at the intersection of the bottom and the sidewall surface slope away from the linear portion of the cavity perimeter, the tendency for the lens to rest in contact with the linear portion of the cavity during storage can be reduced, which in turn prevents or reduces deformation of the lens caused by the lens resting in contact with the linear portion of the cavity perimeter during storage. Also blister packages with cavities having linear perimeter portions which can contact a linear perimeter portion of another blister package when stacked in an inverted reverse arrangement can form more stable stacks and arrays. Additionally, these stable stacks and arrays can be packed efficiency in a box or carton of contact lens packages, as this configuration can reduce the volume of space taken up by a stack or array, and in one example, the stack or array can have a length and width approximately equal to the length L, or the width W, or both the length L and width W of a single blister package. Additionally, the height of a stack or array of blister packages can have a reduced height.

As described, the present devices and methods are effective in improving the efficiency of manufacturing a packaged contact lens. In one example, by packaging the contact lens in the present blister package and subjecting the contact lens to an inspection procedure in the same blister package, the present devices and methods can be effective in improving the yield of acceptable contact lenses by reducing the number of transfers between receptacles and therefore potential damage due to handling the contact lenses.

Figure 12:
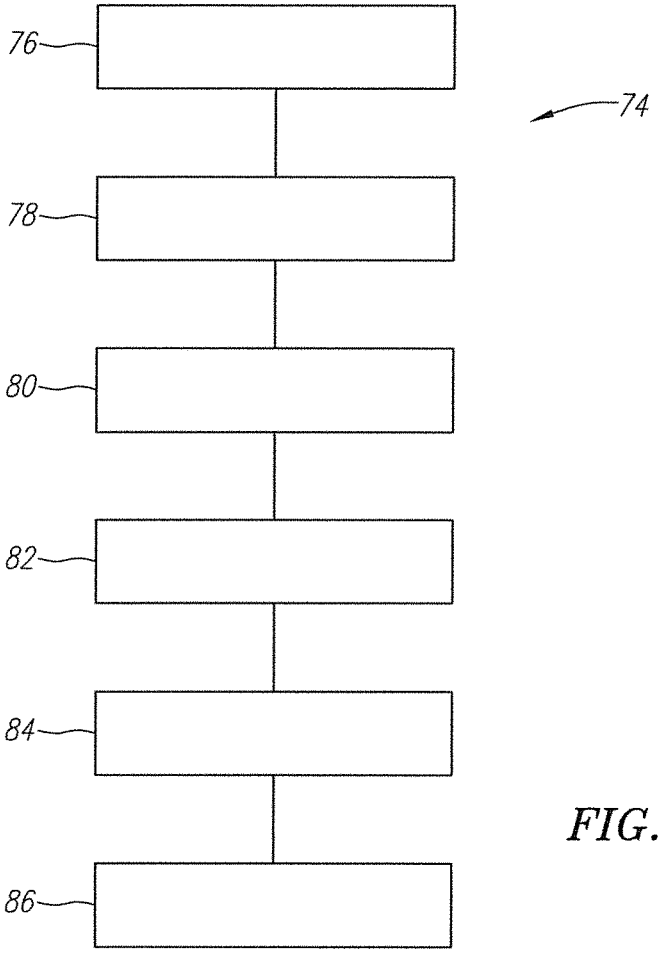
FIG. 12 is a schematic process flow diagram depicting the steps for manufacturing and packaging contact lenses.

With reference now to FIG. 12, a schematic diagram depicting a process for producing, packaging, and shipping contact lenses in a shipping box or carton is shown, which is generally designated as process 74. At step 76, a polymerizable lens precursor composition is placed in a lens-shaped cavity of a contact lens mold assembly, the assembly comprising a first mold member and a second mold member. The contact lens mold assembly containing the polymerizable lens precursor composition is then exposed to conditions effective in curing or polymerizing the polymerizable lens precursor composition, such as heat, UV light, or combinations thereof. After the curing or polymerization step, a polymeric contact lens product is formed in the contact lens shaped cavity of the assembly. In practice, a plurality of polymerized contact lenses are generally produced and processed simultaneously.

At step 78, the contact lens mold assembly is then demolded to separate the first and second mold members from one another. After demolding the contact lens mold assembly, the polymeric lens body is delensed from the mold member to which it is attached. Delensing can be performed using a dry delensing step not involving contacting the lens body with a liquid or a wet delensing step that involves contacting the lens body to a liquid that assists in separating the lens body from the mold member to which it is attached or with which it is in contact.

At step 80 and after delensing the polymeric lens body, the lens body can optionally undergo one or more processing steps that include washing, such as cleaning, extracting, and hydrating processes or combinations thereof, to produce a contact lens that is ready to be inspected or ready to be packaged. At step 82, the hydrated contact lens is placed in a base member of a blister package, is optionally inspected, is sealed, and is sterilized, as understood by persons of ordinary skill in the art. Typically, a single lens is placed in an individual blister package, such as that shown and described with reference to FIGS. 1-11. During the sealing process, a single base member may be sealed with a single sealing member, or a plurality of base members may be sealed using a "strip" of connected sealing members, forming a "strip" of blister packages.

At step 84, a plurality of sealed blister packages or a plurality of strips of sealed blister packages are stacked in pairs and in an inverted reverse arrangement as described above with reference to FIG. 11. The plurality of stacked pairs or strips are stacked four to eight high (i.e., two pairs to four pairs), two to four rows wide, and five to twelve stacks deep to form an array of stacked blister packages. At step 86, the array of stacked blister packages or strips are placed inside a shipping box or carton for shipping. In one example, the stacked blister packages can comprise the following array: two pairs high (four blister packages) by three pairs wide (six blister packages) by five pairs deep (ten blister packages) for a total of thirty blister packages. In another example, the stacked blister strips can comprise the following array: two pairs of 5 blister package strips stacked in an inverted reverse arrangement, stacked with two more pairs of 5 blister package strips stacked in an inverted reverse arrangement (three sets of 10 blister packages stacked vertically), for a total of thirty blister packages.

Figure 13:
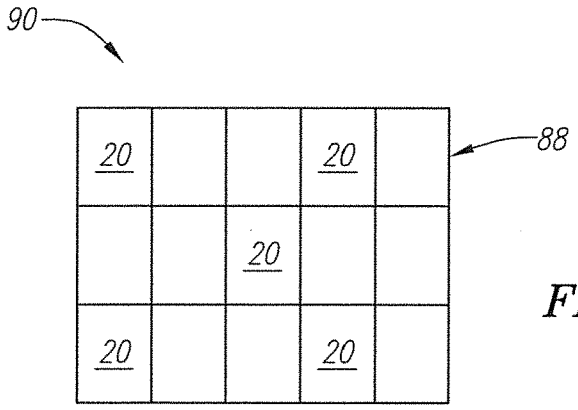
FIG. 13 is a schematic diagram showing a shipping carton or box with an array of blister packages.

FIG. 13 is a schematic diagram showing the array 88 of blister packages 20 placed inside a carton 90. The array 88 is shown as having three rows wide, five rows deep, and two pairs high (into the page). In another example, the total number of blister packages 20 is less than thirty. In still another example, the total number of blister packages is greater than thirty.

As described, the present devices and methods are effective in reducing deformations of the lenses caused by the linear portion of the cavity during storage, and can also be effective in improving the efficiency and/or yield of manufacturing an array or assembly of packaged blister packages. For example, by making the present blister packages relatively more compact, it is possible to improve the packaging efficiency as more packages can be packed into a single box or carton. Furthermore, by efficiently stacking the blister packages with inversely adjacent packages as described herein, it is possible to reduce the size of the resulting carton, which can in turn fit into a regular exterior or curbside mail box or mail slot on a door. This reduces the risk of the box or carton getting lost when left outside of the mail box or mail slot. Still furthermore, by more efficiently packaging a greater number of blister packages into a box or carton, i.e., increasing the density of blister packages in a box or carton by using the disclosed inverted reverse stacking arrangement between two substantially similar blister packages each having a cavity and a flange, more contact lenses can be shipped and delivered to a customer or user via his or her mail box or mail slot.

Thus, aspects of the present package and device, therefore, are directed toward a carton for storing and shipping contact lens package assemblies. The carton comprises a plurality of blister packages each comprising a cavity having a packaging solution and a contact lens, a flange, and a sealing member attached to the flange to seal the cavity. In the base members of the blister packages present in the carton, the plane formed at the intersection of the bottom and the sidewall surface slopes away from the linear portion of the cavity perimeter, reducing the tendency for the lens to rest in contact with the linear portion of the cavity during storage and/or shipping, preventing or reducing deformation of the lenses caused by the lenses resting in contact with the linear portion of the cavity perimeter. The blister packages are stacked inside the carton in an inverted reverse stacking arrangement in which the cavity of a first blister package is placed against the bottom side of the flange of the second blister package so that the cavity of the second blister package also abuts the bottom side of the flange of the first blister package. To further increase the spacing and therefore density of blister packages inside the carton, each cavity has a substantially flat proximal sidewall portion to enable a line contact with an adjacent cavity. In another example, the line contact is increased due to the substantially flat proximal sidewall portion to provide an area contact between two adjacent cavities.

Although the present description is provided with reference to contact lenses, the description, including the devices and methods described herein, can be used for other types of lenses, including corneal onlay lenses, corneal inlay lenses, intraocular lenses, and the like.

Also, although the disclosure herein refers to certain specific examples, it is to be understood that these examples are presented by way of example and not by way of limitation. The intent of the foregoing detailed description in the context of the exemplary examples is to be construed to cover all modifications, alternatives, and equivalents of the examples as may fall within the spirit and scope of the invention as defined by the claims.

The invention claimed is:

1. A contact lens blister package comprising:

a thermoplastic base member comprising a proximal end region having a grip portion, a distal end region, a first side region extending from the proximal end region to the distal end region, a second side region opposing the first side region, and a cavity configured to contain a packaging solution and a contact lens when placed inside the cavity, the cavity being located between the proximal end region and the distal end region and between the first side region and the second side region; wherein the cavity comprises a bottom wall having a bottom wall perimeter and a sidewall extending upwardly from the bottom wall perimeter to an upper cavity edge defining a cavity perimeter and including a substantially linear upwardly extending sidewall portion;

the cavity perimeter comprises a substantially linear portion and a non-linear portion opposing the substantially linear portion; and a plane formed at the intersection of the bottom wall perimeter with the sidewall slopes away from the substantially linear portion of the cavity perimeter.

2. The contact lens blister package of claim 1, wherein the cavity further comprises a flange extending outwardly therefrom, and the flange includes a sealing area.

3. The contact lens package of claim 2, wherein the contact lens blister package further comprises a support rib extending from a distal most end of the flange.

4. The contact lens blister package of claim 1, wherein the cavity is a light collimation cavity.

5. The contact lens blister package of claim 1, wherein when the blister package is positioned on a horizontal surface with the cavity opening facing up and with both a proximal edge and the bottom wall of the base member contacting the horizontal surface, the plane formed at the intersection of the bottom wall and the sidewall is parallel to the horizontal surface.

6. The contact lens blister package of claim 1, wherein the plane formed at the intersection of the bottom wall and the sidewall is not parallel to a plane defined by the cavity perimeter.

7. The contact lens blister package of claim 1, wherein the contact lens blister package is a first contact lens blister package and wherein the base member of the first contact lens blister package is stacked against a second substantially identical contact lens blister package in an inverted reverse arrangement to form a stack of two substantially identical contact lens blister packages having a height of from 1.0 to 1.25 times a height (H) of the first contact lens blister package, a length of from 1.0 to 1.25 times a length (L) of the first contact lens blister package, and a width of from 1.0 to 1.25 times a width (W) of the first contact lens blister package.

8. The contact lens blister package of claim 1, wherein the substantially linear portion of the cavity perimeter is a substantially linear proximal portion; the opposing non-linear portion of the cavity perimeter comprises an opposing non-linear distal portion of the cavity perimeter; and the substantially linear proximal portion intersects a length of the base member extending longitudinally from a distal most end to an opposing proximal edge of the base member.

9. The contact lens blister package of claim 1, wherein the base member has dimensions comprising a maximum length (L) of 47.8 mm, a maximum width (W) of 30.5 mm, and a maximum height (H) of 9.5 mm.

10. The contact lens blister package of claim 9, wherein the dimensions of the base member are substantially the same following autoclaving as before autoclaving.

11. The contact lens blister package of claim 1, wherein the cavity of the base member has a maximum cavity length ($L_C$) of 18.9 mm, a maximum cavity width ($W_C$) of 22.5 mm, and a maximum cavity depth ($D_C$) of 8.7 mm.

12. The contact lens blister package of claim 1, wherein the cavity has a volume of from 1.7 milliliters to 2.5 milliliters.

13. The contact lens blister package of claim 1, wherein the contact lens blister package is a first contact lens blister package and wherein the base member of the first contact lens blister package is stacked against a second substantially identical contact lens blister package in an inverted reverse arrangement to form a stack of two contact lens blister packages having at least one type of contact between the base member of the first contact lens blister package and a base member of the second contact lens blister package, wherein the at least one type of contact is a line contact between a linear sidewall portion of the base member of the first contact lens blister package and a linear sidewall portion of the base member of the second contact lens blister package, or an edge contact between a support rib of the base member of the first contact lens blister package and a proximal edge of the base member of the second contact lens blister package, or an edge contact between a proximal edge of the base member of the first contact lens blister package and a support rib of the base member of the second contact lens blister package, or any combination thereof.

14. A contact lens package assembly comprising:

a first blister package and a second blister package, wherein the second blister package is substantially identical to the first blister package;

the first blister package and the second blister package each comprises a thermoplastic base member comprising a proximal end region having a grip portion; a distal end region; a first side region extending from the proximal end region to the distal end region; a second side region opposing the first side region; and a cavity configured to contain a packaging solution and a contact lens when placed inside the cavity, the cavity being located between the proximal end region and the distal end region and between the first side region and the second side region; the cavity comprises a bottom wall having a bottom wall perimeter and a sidewall extending upwardly from the bottom wall perimeter to an upper cavity edge defining a cavity perimeter; the cavity perimeter comprises a substantially linear portion and a non-linear portion opposing the substantially linear portion; and a plane formed at the intersection of the bottom wall perimeter and the sidewall slopes away from the substantially linear portion of the cavity perimeter; and the base member of the first blister package and the base member of the second blister package are configured such that the base member of the second blister package is stackable against the base member of the first blister package in an inverted reverse arrangement.

15. The contact lens package assembly of claim 14, wherein a linear sidewall portion of the base member of the first blister package forms a line contact with a linear sidewall portion of the stacked base member of the second blister package.

16. The contact lens package assembly of claim 14, wherein the cavity of the base member of the first blister package and the cavity of the base member of the second blister package each contain a contact lens in a packaging solution.

17. The contact lens package assembly of claim 14, wherein the base member of the first blister package and the base member of the second blister package each further comprises a flange comprising a sealing area and a sealing member removably attached to the sealing area.

18. The contact lens package assembly of claim 14, wherein the base member of the first blister package and the base member of the second blister package each further comprises a support rib extending from a distal most end of the base member, and wherein the proximal edge of the base member of the first blister package abuts the support rib of the stacked base member of the second blister package when the two base members are stacked in an inverted reverse arrangement.

19. The contact lens package assembly of claim 14, wherein dimensions of both the first blister package and the second blister package are substantially the same following autoclaving as before autoclaving, and the base member of the first blister package and the base member of the second blister package are stackable in the inverted reverse arrangement following autoclaving.

20. A method of manufacturing a packaged contact lens, comprising:

providing a demolded and delensed polymeric contact lens body;

placing the contact lens body in a thermoplastic base member of a contact lens blister package with a packaging solution; and sealing the contact lens blister package with a sealing member; wherein the base member comprises a proximal end region having a grip portion, a distal end region, a first side region extending from the proximal end region to the distal end region, a second side region opposing the first side region, and a cavity configured to contain a packaging solution and a contact lens when placed in the cavity, the cavity being located between the proximal end region and the distal end region and between the first side region and the second side region; the cavity comprises a bottom wall having a bottom wall perimeter and a sidewall extending upwardly from the bottom wall perimeter to an upper cavity edge defining a cavity perimeter; the cavity perimeter comprises a substantially linear portion and a non-linear portion opposing the substantially linear portion; and a plane formed at the intersection of the bottom wall perimeter with the sidewall slopes away from the substantially linear portion of the cavity perimeter.

* * * * *